US011302457B2

(12) United States Patent
Kusakari et al.

(10) Patent No.: US 11,302,457 B2
(45) **Date of Patent: *Apr. 12, 2022**

(54) ALUMINUM ALLOY WIRE, ALUMINUM ALLOY STRAND WIRE, COVERED ELECTRICAL WIRE, AND TERMINAL-EQUIPPED ELECTRICAL WIRE

(71) Applicants: Sumitomo Electric Industries, Ltd., Osaka (JP); AutoNetworks Technologies, Ltd., Yokkaichi (JP); Sumitomo Wiring Systems, Ltd., Yokkaichi (JP)

(72) Inventors: Misato Kusakari, Osaka (JP); Tetsuya Kuwabara, Osaka (JP); Yoshihiro Nakai, Osaka (JP); Taichiro Nishikawa, Osaka (JP); Yasuyuki Otsuka, Yokkaichi (JP); Hayato Ooi, Yokkaichi (JP)

(73) Assignees: Sumitomo Electric Industries, Ltd., Osaka (JP); AutoNetworks Technologies, Ltd., Yokkaichi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/131,860

(22) Filed: Dec. 23, 2020

(65) Prior Publication Data

US 2021/0110947 A1 Apr. 15, 2021

Related U.S. Application Data

(63) Continuation of application No. 16/346,151, filed as application No. PCT/JP2017/014043 on Apr. 4, 2017, now Pat. No. 10,910,125.

(30) Foreign Application Priority Data

Oct. 31, 2016 (JP) ..... JP2016-213153

(51) Int. Cl.
*H01B 1/02* (2006.01)
*C22C 21/08* (2006.01)
(Continued)

(52) U.S. Cl.
CPC ..... *H01B 1/023* (2013.01); *C22C 21/08* (2013.01); *C22C 21/10* (2013.01); *C22C 21/14* (2013.01);
(Continued)

(58) Field of Classification Search
CPC ..... H01B 1/023
See application file for complete search history.

(56) References Cited

U.S. PATENT DOCUMENTS 3,613,767 A 10/1971 Cofer et al.
7,479,597 B1 1/2009 Cases et al.
(Continued)

FOREIGN PATENT DOCUMENTS

CN 101128887 A 2/2008
CN 104538116 A 4/2015
(Continued)

OTHER PUBLICATIONS

"Organization of aluminum, property and Japan," Japan Institute of Light Metals, Nov. 30, 1991, pp. 376-396. [Cited in Parent].
(Continued)

*Primary Examiner* — Chau N Nguyen
(74) *Attorney, Agent, or Firm* — Baker Botts L.L.C.; Michael A. Sartori

(57) ABSTRACT

An aluminum alloy contains at least 0.03 mass % and at most 1.5 mass % of Mg, at least 0.02 mass % and at most
(Continued)

2.0 mass % of Si, and a remainder composed of Al and an inevitable impurity, a mass ratio Mg/Si being not lower than 0.5 and not higher than 3.5. In a transverse section of the aluminum alloy wire, a rectangular surface-layer void measurement region having a short side of 30 μm long and a long side of 50 μm long is taken from a surface-layer region extending by up to 30 μm in a direction of depth from a surface of the aluminum alloy wire. A total cross-sectional area of voids present in the surface-layer void measurement region is not greater than 2 $\mu m^2$.

12 Claims, 3 Drawing Sheets

(51) Int. Cl.

| | |
|---|---|
| ***C22C 21/10*** | (2006.01) |
| ***C22C 21/14*** | (2006.01) |
| ***C22C 21/16*** | (2006.01) |
| ***C22F 1/05*** | (2006.01) |
| ***C22F 1/053*** | (2006.01) |
| ***C22F 1/057*** | (2006.01) |
| ***H01B 5/08*** | (2006.01) |
| ***H01B 7/00*** | (2006.01) |
| *H01R 4/18* | (2006.01) |

(52) U.S. Cl.
CPC ..... *C22C 21/16* (2013.01); *C22F 1/05* (2013.01); *C22F 1/053* (2013.01); *C22F 1/057* (2013.01); *H01B 5/08* (2013.01); *H01B 7/0009* (2013.01); *H01R 4/185* (2013.01)

(56) References Cited

U.S. PATENT DOCUMENTS

| | | | |
|---|---|---|---|
| 10,522,263 | B2 | 12/2019 | Kusakari et al. |
| 10,910,125 | B2 * | 2/2021 | Kusakari ..... C22C 21/14 |
| 2004/0256139 | A1 | 12/2004 | Clark |
| 2008/0196923 | A1 | 8/2008 | Susai et al. |
| 2010/0059151 | A1 | 3/2010 | Iwamura et al. |
| 2012/0217060 | A1 | 8/2012 | Kusakari et al. |
| 2014/0047942 | A1 | 2/2014 | Tsuda et al. |
| 2014/0290320 | A1 | 10/2014 | Maeda et al. |
| 2018/0169383 | A1 | 6/2018 | Khalaj et al. |
| 2019/0267152 | A1 | 8/2019 | Kusakari et al. |

FOREIGN PATENT DOCUMENTS

| | | | |
|---|---|---|---|
| EP | 2381001 | A1 | 10/2011 |
| EP | 2383357 | A1 | 11/2011 |
| EP | 3228719 | A1 | 10/2017 |
| JP | S49-026162 | B | 7/1974 |
| JP | S51-054816 | A | 5/1976 |
| JP | 2003-303517 | A | 10/2003 |
| JP | 2012-229485 | A | 11/2012 |
| JP | 2015-005485 | A | 1/2015 |
| JP | 2015-124409 | A | 7/2015 |
| JP | 2015-166480 | A | 9/2015 |
| JP | 2015-196881 | A | 11/2015 |
| KR | 10-2014-0045406 | A | 4/2014 |
| WO | 2010/082670 | A1 | 7/2010 |
| WO | 2010/082671 | A1 | 7/2010 |
| WO | 2016/088889 | A1 | 6/2016 |

OTHER PUBLICATIONS

Office Action, Japanese Application No. 2016-213153, dated Dec. 7, 2016, 8 pages. [Cited in Parent].
Notice of Allowance issued in U.S. Appl. No. 16/346,479 dated Aug. 12, 2019. [Cited in Parent].

* cited by examiner

FIG.5

| MANUFACTURING METHOD | WR | HEAT TREATMENT | STRIPPING | WIRE DRAWING | INTERMEDIATE HEAT TREATMENT | WIRE DRAWING | HEAT TREATMENT (CONTINUOUS) | AGING | SAMPLE No. |
|---|---|---|---|---|---|---|---|---|---|
| A | ✓ | – | – | ✓ | – | ✓ | ✓ | ✓ | 72 |
| B | ✓ | ✓ | – | ✓ | – | ✓ | – | ✓ | 73 |
| C | ✓ | ✓ | – | ✓ | – | ✓ | ✓ | ✓ | OTHERS |
| D | ✓ | – | ✓ | ✓ | ✓ | ✓ | ✓ | ✓ | 74 |
| E | ✓ | ✓ | ✓ | ✓ | ✓ | ✓ | ✓ | ✓ | 75 |
| F | ✓ | – | – | ✓ | – | ✓ | – | ✓ | 76 |
| G | ✓ | ✓ | – | ✓ | – | ✓ | – | ✓ | 77 |

ALUMINUM ALLOY WIRE, ALUMINUM ALLOY STRAND WIRE, COVERED ELECTRICAL WIRE, AND TERMINAL-EQUIPPED ELECTRICAL WIRE

TECHNICAL FIELD

The present invention relates to an aluminum alloy wire, an aluminum alloy strand wire, a covered electrical wire, and a terminal-equipped electrical wire.

The present application claims priority to Japanese Patent Application No. 2016-213153 filed on Oct. 31, 2016, the entire contents of which are herein incorporated by reference.

BACKGROUND ART

PTL 1 discloses an extremely thin aluminum alloy wire which is composed of an Al—Mg—Si based alloy, high in strength and also in electrical conductivity, and excellent also in elongation.

CITATION LIST

Patent Literature

PTL 1: Japanese Patent Laying-Open No. 2012-229485

SUMMARY OF INVENTION

An aluminum alloy wire in the present disclosure is an aluminum alloy wire composed of an aluminum alloy, the aluminum alloy containing at least 0.03 mass % and at most 1.5 mass % of Mg, at least 0.02 mass % and at most 2.0 mass % of Si, and a remainder composed of Al and an inevitable impurity, a mass ratio Mg/Si being not lower than 0.5 and not higher than 3.5, in a transverse section of the aluminum alloy wire, a rectangular surface-layer void measurement region having a short side of 30 μm long and a long side of 50 μm long being taken from a surface-layer region extending by up to 30 μm in a direction of depth from a surface of the aluminum alloy wire, a total cross-sectional area of voids present in the surface-layer void measurement region being not greater than 2 $\mu m^2$, the aluminum alloy wire having a diameter not smaller than 0.1 mm and not greater than 3.6 mm, tensile strength not lower than 150 MPa, 0.2% proof stress not lower than 90 MPa, breaking elongation not lower than 5%, and electrical conductivity not lower than 40% IACS.

An aluminum alloy strand wire in the present disclosure is made by stranding together a plurality of the aluminum alloy wires in the present disclosure.

A covered electrical wire in the present disclosure includes a conductor and an insulation cover which covers an outer circumference of the conductor, the conductor including the aluminum alloy strand wire in the present disclosure.

A terminal-equipped electrical wire in the present disclosure includes the covered electrical wire in the present disclosure and a terminal portion attached to an end portion of the covered electrical wire.

BRIEF DESCRIPTION OF DRAWINGS

FIG. 5 is an explanatory diagram explaining a step of manufacturing an aluminum alloy wire.

DETAILED DESCRIPTION

Figure 1:
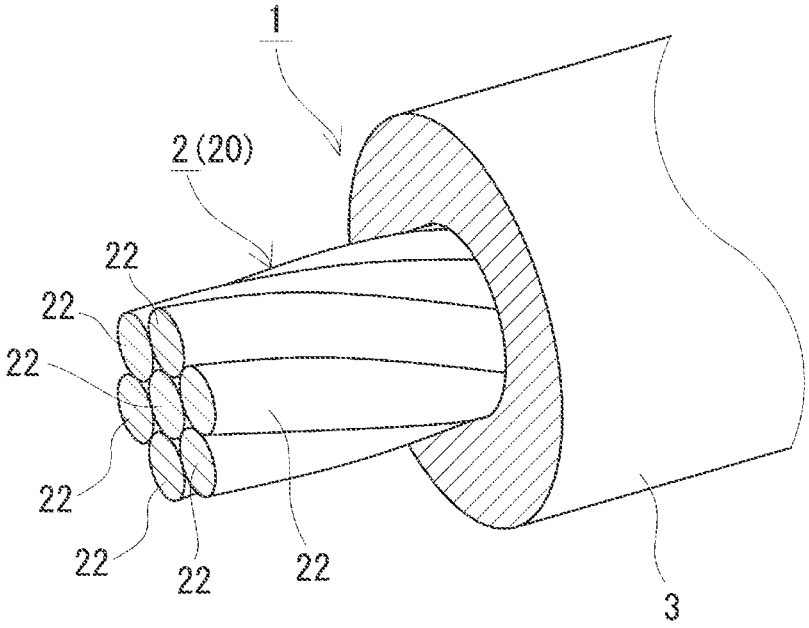
FIG. 1 is a schematic perspective view showing a covered electrical wire including an aluminum alloy wire in an embodiment as a conductor.

Problem to be Solved by the Present Disclosure

An aluminum alloy wire excellent in impact resistance and also in fatigue characteristics is desired as a wire member to be used for a conductor equipped in an electrical wire.

Electrical wires for various applications such as a wire harness provided in equipment such as cars and aircrafts, wires for various electrical appliances such as industrial robots, and wires in buildings may receive impact or repeated bending when such equipment is used or installed. Specific examples (1) to (3) are given below.

(1) In an electrical wire equipped in a wire harness for cars, impact may be applied to the vicinity of a terminal portion in attaching the electrical wire to a connection target (PTL 1). In addition, sudden impact may be applied depending on a state of travel of a car, or repeated bending may be applied by vibration during travel of a car.

(2) An electrical wire routed in an industrial robot may repeatedly be bent or twisted.

(3) To an electrical wire routed in a building, impact may be applied due to sudden strong tension or inadvertent drop by an operator during installation, or the electrical wire may repeatedly be bent by waving for removing waviness of a wire member wound like a coil.

Therefore, the aluminum alloy wire to be used for a conductor equipped in an electrical wire is desirably less likely to break even though not only impact but also repeated bending is applied.

One of objects is to provide an aluminum alloy wire excellent in impact resistance and fatigue characteristics. Another of the objects is to provide an aluminum alloy strand wire, a covered electrical wire, and a terminal-equipped electrical wire excellent in impact resistance and fatigue characteristics.

Advantageous Effect of the Present Disclosure

An aluminum alloy wire in the present disclosure, an aluminum alloy strand wire in the present disclosure, a covered electrical wire in the present disclosure, and a terminal-equipped electrical wire in the present disclosure are excellent in impact resistance and fatigue characteristics.

The present inventors have manufactured aluminum alloy wires under various conditions, and studied aluminum alloy wires excellent in impact resistance and fatigue characteristics (less likeliness to break against repeated bending). A wire member composed of a specifically composed aluminum alloy containing Mg and Si within a specific range and subjected in particular to aging treatment is high in strength (for example, high in tensile strength or 0.2% proof stress), high in electrical conductivity, and also excellent in electrical conductive property. The present inventors have found that a smaller number of voids in particular in a surface layer of this wire member leads to excellent impact resistance and less likeliness of break in spite of repeated bending. The present inventors have found that an aluminum alloy wire containing a small number of voids in the surface layer can be manufactured, for example, by controlling a temperature of a melt of an aluminum alloy to be cast within a specific range. The invention of the present application is based on such findings. Contents of an embodiment of the invention of the present application will initially be listed and described.

Description of Embodiment of the Invention of the Present Application (1) An aluminum alloy wire according to one manner of the invention of the present application is an aluminum alloy wire composed of an aluminum alloy, the aluminum alloy containing at least 0.03 mass % and at most 1.5 mass % of Mg, at least 0.02 mass % and at most 2.0 mass % of Si, and a remainder composed of Al and an inevitable impurity, a mass ratio Mg/Si being not lower than 0.5 and not higher than 3.5, in a transverse section of the aluminum alloy wire, a rectangular surface-layer void measurement region having a short side of 30 μm long and a long side of 50 μm long being taken from a surface-layer region extending by up to 30 μm in a direction of depth from a surface of the aluminum alloy wire, a total cross-sectional area of voids present in the surface-layer void measurement region being not greater than 2 $\mu m^2$, the aluminum alloy wire having a diameter not smaller than 0.1 mm and not greater than 3.6 mm, tensile strength not lower than 150 MPa, 0.2% proof stress not lower than 90 MPa, breaking elongation not lower than 5%, and electrical conductivity not lower than 40% IACS.

The transverse section of the aluminum alloy wire refers to a cross-section obtained by cutting along a surface orthogonal to an axial direction (a longitudinal direction) of the aluminum alloy wire.

The aluminum alloy wire (which may be called an Al alloy wire below) is composed of a specifically composed aluminum alloy (which may be called an Al alloy below). The aluminum alloy wire is high in strength, less likely to break even though it is repeatedly bent, and excellent in fatigue characteristics, by being subjected to aging treatment in a manufacturing process. The aluminum alloy wire is high in breaking elongation and toughness and excellent also in impact resistance. In particular, the Al alloy wire is small in number of voids in a surface layer. Therefore, even though impact is applied to the Al alloy wire or the Al alloy wire is repeatedly bent, a void is less likely to be a starting point of cracking and cracking originating from a void is less likely. As surface cracking is less likely, development of cracking from a surface of a wire member to the inside or resultant breakage can also be lessened. Therefore, the Al alloy wire is excellent in impact resistance and fatigue characteristics. Since the Al alloy wire is less likely to suffer from cracking originating from a void, it tends to be higher in at least one selected from tensile strength, 0.2% proof stress, and breaking elongation in a tensile test, although depending on a composition or a condition for heat treatment. The Al alloy wire is excellent also in mechanical characteristics.

(2) An exemplary form of the Al alloy wire is such that, in the transverse section of the aluminum alloy wire, a rectangular inside void measurement region having a short side of 30 μm long and a long side of 50 μm long is taken such that a center of this rectangle is superimposed on a center of the aluminum alloy wire, and a ratio of a total cross-sectional area of voids present in the inside void measurement region to the total cross-sectional area of the voids present in the surface-layer void measurement region is not lower than 1.1 and not higher than 44.

In the form, the ratio of the total cross-sectional area described above is not lower than 1.1. Therefore, though more voids are present inside than in the surface layer of the Al alloy wire, the ratio of the total cross-sectional area described above satisfies the specific range and hence it can be concluded that there are a small number of voids also in the inside. Therefore, the form is better in impact resistance and fatigue characteristics because cracking is less likely to develop from the surface of the wire member to the inside through the voids and break is less likely even though impact or repeated bending is applied.

(3) An exemplary form of the Al alloy wire is such that the aluminum alloy further contains at most 1.0 mass % in total of at least one element selected from among Fe, Cu, Mn, Ni, Zr, Cr, Zn, and Ga, Fe is contained within a range not lower than 0.01 mass % and not higher than 0.25 mass %, each of Cu, Mn, Ni, Zr, Cr, and Zn is contained within a range not lower than 0.01 mass % and not higher than 0.5 mass %, and Ga is contained within a range not lower than 0.005 mass % and not higher than 0.1 mass %.

The form contains the element described above within a specific range, in addition to Mg and Si. Therefore, further improvement in strength or improvement in toughness by making crystals finer can be expected.

(4) An exemplary form of the Al alloy wire is such that the aluminum alloy further contains at least one of at least 0 mass % and at most 0.05 mass % of Ti and at least 0 mass % and at most 0.005 mass % of B.

Ti or B tends to make crystal grains finer during casting. By making use of a cast material having fine crystal structure as a base material, consequently, an Al alloy wire having fine crystal structure tends to be obtained. The form has fine crystal structure, breakage is less likely when impact or repeated bending is applied, and excellent impact resistance and fatigue characteristics are obtained.

(5) An exemplary form of the Al alloy wire is such that the aluminum alloy has an average crystal grain size not greater than 50 μm.

The form includes fine crystal grains and is excellent in pliability in addition to being small in number of voids. Therefore, better impact resistance and fatigue characteristics are achieved.

(6) An exemplary form of the Al alloy wire is such that a work hardening exponent is not smaller than 0.05.

Since the form satisfies a specific range of the work hardening exponent, improvement in force of fixing a terminal portion by work hardening at the time of attachment of the terminal portion by crimping can be expected. Therefore, the form can suitably be made use of for a conductor to which a terminal portion is to be attached such as a terminal-equipped electrical wire.

(7) An exemplary form of the Al alloy wire is such that the aluminum alloy wire has a surface oxide film having a thickness not smaller than 1 nm and not greater than 120 nm.

In the form, a thickness of the surface oxide film satisfies a specific range. Therefore, less oxide (which forms a surface oxide film) is interposed between the aluminum alloy wire and the terminal portion when the terminal portion is attached. Increase in connection resistance due to excessive interposition of an oxide can be prevented. In addition, excellent corrosion resistance is also achieved. Therefore, the form can suitably be made use of for a conductor to which a terminal portion is to be attached such as a terminal-equipped electrical wire. In this case, a connection structure excellent in impact resistance and fatigue characteristics and in addition low in resistance and excellent also in corrosion resistance can be constructed.

(8) An exemplary form of the Al alloy wire is such that a content of hydrogen is not more than 8.0 ml/100 g.

The present inventors have examined a gas component contained in an Al alloy wire which contains voids, and found that the Al alloy wire contains hydrogen. Therefore, hydrogen may be one factor for voids in the Al alloy wire. Since the form can be concluded as containing a small number of voids also based on a low content of hydrogen, the form is less likely to suffer from break originating from a void and is excellent in impact resistance and fatigue characteristics.

(9) An aluminum alloy strand wire according to one manner of the invention of the present application is made by stranding together a plurality of the aluminum alloy wires described in any one of (1) to (8).

Each elemental wire forming the aluminum alloy strand wire (which may be called an Al alloy strand wire below) is composed of a specifically composed Al alloy as described above and contains a small number of voids in a surface layer thereof. Therefore, it is excellent in impact resistance and fatigue characteristics. A strand wire is generally better in flexibility than a solid wire identical in conductor cross-sectional area. Even though impact or repeated bending is applied to the strand wire, each elemental wire is less likely to break and excellent in impact resistance and fatigue characteristics. In this regard, the Al alloy strand wire is excellent in impact resistance and fatigue characteristics. Since each elemental wire is excellent in mechanical characteristics as described above, the Al alloy strand wire tends to be higher in at least one selected from tensile strength, 0.2% proof stress, and breaking elongation, and it is also excellent in mechanical characteristics.

(10) An exemplary form of the Al alloy strand wire is such that a strand pitch is at least 10 times and at most 40 times as large as a pitch diameter of the aluminum alloy strand wire.

The pitch diameter refers to a diameter of a circle defined by a series of centers of all elemental wires included in each layer of a multi-layered structure of a strand wire.

According to the form, a strand pitch satisfies a specific range. Therefore, the form is less likely to suffer from breakage because elemental wires are less likely to twist in bending. In addition, electrical wires are less likely to be unbound in attachment of a terminal portion, and hence attachment of the terminal portion is facilitated. Therefore, the form is particularly excellent in fatigue characteristics and can suitably be made use of for a conductor to which a terminal portion is to be attached such as a terminal-equipped electrical wire.

A covered electrical wire according to one manner of the invention of the present application includes a conductor and an insulation cover which covers an outer circumference of the conductor, the conductor including the aluminum alloy strand wire described in (9) or (10).

Since the covered electrical wire includes a conductor made of the Al alloy strand wire excellent in impact resistance and fatigue characteristics described above, it is excellent in impact resistance and fatigue characteristics.

(12) A terminal-equipped electrical wire according to one manner of the invention of the present application includes the covered electrical wire described in (11) and a terminal portion attached to an end portion of the covered electrical wire.

Since the terminal-equipped electrical wire includes as its component, the covered electrical wire including the conductor made of the Al alloy wire or the Al alloy strand wire excellent in impact resistance and fatigue characteristics described above, it is excellent in impact resistance and fatigue characteristics.

Details of Embodiment of the Invention of the Present Application

An embodiment of the invention of the present application will be described in detail below with reference to the drawings as appropriate. An identical reference in the drawings refers to objects identical in label. A content of an element in the description below is represented by mass %.

[Aluminum Alloy Wire]

(Overview)

An aluminum alloy wire (Al alloy wire) 22 in an embodiment is a wire member composed of an aluminum alloy (Al alloy) and representatively used for a conductor 2 of an electrical wire (FIG. 1). In this case, Al alloy wire 22 is used as a solid wire, a strand wire obtained by stranding together a plurality of Al alloy wires 22 (an Al alloy strand wire 20 in the embodiment), or a compressed strand wire obtained by compression forming a strand wire into a prescribed shape (another example of Al alloy strand wire 20 in the embodiment). FIG. 1 shows Al alloy strand wire 20 obtained by stranding together seven Al alloy wires 22. Al alloy wire 22 in the embodiment is specifically composed such that the Al alloy contains Mg and Si within a specific range and has such specific structure that a small number of voids are present in a surface layer thereof. Specifically, the Al alloy which makes up Al alloy wire 22 in the embodiment is an Al—Mg—Si based alloy which contains at least 0.03% and at most 1.5% of Mg, at least 0.02% and at most 2.0% of Si, and a remainder composed of Al and an inevitable impurity, a mass ratio Mg/Si being not lower than 0.5 and not higher than 3.5. In Al alloy wire 22 in the embodiment, in a transverse section thereof, a total cross-sectional area of voids present in a region below taken from a surface-layer region extending by up to 30 μm in a direction of depth from a surface of the Al alloy wire (which is called a surface-layer void measurement region) is not greater than 2 $\mu m^2$. The surface-layer void measurement region is defined as a rectangular region having a short side of 30 μm long and a long side of 50 μm long. Al alloy wire 22 in the embodiment which has the specific composition described above and specific structure is high in strength by being subjected to aging treatment in a manufacturing process, and it is also less likely to suffer from breakage originating from a void. Therefore, the Al alloy wire is excellent also in impact resistance and fatigue characteristics.

Further detailed description will be given below. Details of a method of measuring each parameter such as a size of a void and details of the effects described above will be described in a test example.

(Composition)

Al alloy wire 22 in the embodiment is composed of an Al—Mg—Si based alloy and it is excellent in strength because Mg and Si are present therein in a state of a solid solution and also as a crystallized material and a precipitated material. Mg is an element high in effect of improvement in strength. By containing Mg within a specific range simultaneously with Si, specifically by containing at least 0.03% of Mg and at least 0.02% of Si, strength can effectively be improved by age hardening. As a content of Mg and Si is higher, strength of the Al alloy wire is higher. By containing Mg within a range not higher than 1.5% and containing Si within a range not higher than 2.0%, lowering in electrical conductivity or toughness resulting from Mg and Si is less likely, electrical conductivity or toughness is high, break is less likely in wire drawing, and manufacturability is also excellent. In consideration of balance among strength, toughness, and electrical conductivity, a content of Mg can be not lower than 0.1% and not higher than 2.0%, further not lower than 0.2% and not higher than 1.5%, and not lower than 0.3% and not higher than 0.9%, and a content of Si can be not lower than 0.1% and not higher than 2.0%, further not lower than 0.1% and not higher than 1.5%, and not lower than 0.3% and not higher than 0.8%.

When a content of Mg and Si is set within the specific range described above and a mass ratio between Mg and Si is set within a specific range, one element is not excessive and Mg and Si can appropriately be present in a state of a crystallized material or a precipitated material. Therefore, excellent strength or electrical conductive property is preferably obtained. Specifically, a ratio of a mass of Mg to a mass of Si (Mg/Si) is preferably not lower than 0.5 and not higher than 3.5, not lower than 0.8 and not higher than 3.5, and more preferably not lower than 0.8 and not higher than 2.7.

The Al alloy which makes up Al alloy wire 22 in the embodiment can contain, in addition to Mg and Si, at least one element selected from among Fe, Cu, Mn, Ni, Zr, Cr, Zn, and Ga (which may collectively be called an element a below). Fe and Cu are less likely to cause lowering in electrical conductivity and can improve strength. Though Mn, Ni, Zr, and Cr are likely to lower electrical conductivity, they are high in effect of improvement in strength. Zn is less likely to lower electrical conductivity and has an effect of improvement in strength to some extent. Ga effectively improves strength. With improved strength, fatigue characteristics are excellent. Fe, Cu, Mn, Zr, and Cr are effective in making crystals finer. With fine crystal structure, toughness such as breaking elongation is excellent and pliability is excellent so that bending is facilitated. Therefore, improvement in impact resistance and fatigue characteristics can be expected. A content of each of listed elements is not lower than 0% and not higher than 0.5%, and a total content of the listed elements is not lower than 0% and not higher than 1.0%. In particular, when a content of each element is not lower than 0.01% and not higher than 0.5% and a total content of the listed elements is not lower than 0.01% and not higher than 1.0%, an effect of improvement in strength and an effect of improvement in impact resistance and fatigue characteristics described above are readily obtained. A content of each element is set, for example, as below. Within a range of the total content above and a range of a content of each element below, a higher content tends to lead to improvement in strength and a lower content tends to lead to higher electrical conductivity:

(Fe) Not lower than 0.01% and not higher than 0.25% and further not lower than 0.01% and not higher than 0.2%;

(each of Cu, Mn, Ni, Zr, Cr, and Zn) Not lower than 0.01% and not higher than 0.5% and further not lower than 0.01% and not higher than 0.3%; and (Ga) Not lower than 0.005% and not higher than 0.1% and further not lower than 0.005% and not higher than 0.05%.

When pure aluminum employed as a source material is subjected to component analysis and it contains an element such as Mg, Si, and/or element a as an impurity in the source material, an amount of addition of each element is desirably adjusted such that a content of the element is set to a desired amount. The content of each additive element described above refers to a total amount inclusive of a content of the element in aluminum metal itself to be employed as a source material, and it does not necessarily mean an amount of addition.

An Al alloy which makes up Al alloy wire 22 in the embodiment can contain, in addition to Mg and Si, at least one of Ti and B. Ti or B is effective in making crystals of the Al alloy finer in casting. By adopting a cast material having fine crystal structure as a base material, crystal grains tend to be fine even though working such as rolling or wire drawing or heat treatment including aging treatment is performed after casting. Al alloy wire 22 having fine crystal structure is less likely to suffer from breakage in application of impact or repeated bending thereto than an Al alloy wire having coarse crystal structure, and it is excellent in impact resistance and fatigue characteristics. The effect of making crystal grains finer tends to increase in the order of an example containing B alone, an example containing Ti alone, and an example containing both of Ti and B. When a content of Ti is not lower than 0% and not higher than 0.005% and further not lower than 0.005% and not higher than 0.05% in an example containing Ti and when a content of B is not lower than 0% and not higher than 0.005% and further not lower than 0.001% and not higher than 0.005% in an example containing B, the effect of making crystals finer is obtained and lowering in electrical conductivity resulting from Ti or B can be lessened. In consideration of balance between the effect of making crystals finer and electrical conductivity, the content of Ti can be not lower than 0.01% and not higher than 0.04% and further not higher than 0.03%, and the content of B can be not lower than 0.002% and not higher than 0.004%.

A specific example of a composition containing element a described above and the like in addition to Mg and Si is shown below. In the specific example below, a mass ratio Mg/Si is preferably not lower than 0.5 and not higher than 3.5.

(1) Mg is contained by at least 0.03% and at most 1.5%, Si is contained by at least 0.02% and at most 2.0%, Fe is contained by at least 0.01% and at most 0.25%, and the remainder is composed of Al and an inevitable impurity.

(2) Mg is contained by at least 0.03% and at most 1.5%, Si is contained by at least 0.02% and at most 2.0%, Fe is contained by at least 0.01% and at most 0.25%, at least one element selected from among Cu, Mn, Ni, Zr, Cr, Zn, and Ga is contained by at least 0.01% and at most 0.3% in total, and the remainder is composed of Al and an inevitable impurity.

(3) In (1) or (2), at least one of at least 0.005% and at most 0.05% of Ti and at least 0.001% and at most 0.005% of B is contained.

(Structure)

Voids

Figure 3:
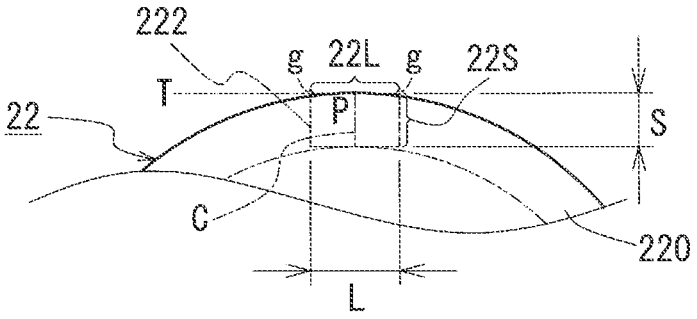
FIG. 3 is an illustrative view illustrating a method of measuring voids.

Al alloy wire 22 in the embodiment contains a small number of voids in its surface layer. Specifically, in a transverse section of Al alloy wire 22, as shown in FIG. 3, a surface-layer region 220 which extends by up to 30 μm in a direction of depth from a surface of the Al alloy wire, that is, an annular region having a thickness of 30 μm, is taken. A rectangular surface-layer void measurement region 222 (shown with a dashed line in FIG. 3) having a short side length S of 30 μm and a long side length L of 50 μm is taken from surface-layer region 220. Short side length S corresponds to a thickness of surface-layer region 220. Specifically, a tangential line T is drawn at any point (a contact P) at the surface of Al alloy wire 22. A straight line C from contact P toward the inside of Al alloy wire 22 which has a length of 30 μm in a direction of normal to the surface is drawn. In an example where Al alloy wire 22 is a round wire, straight line C toward the center of a circle is drawn. A straight line in parallel to straight line C having a length of 30 μm is defined as a short side 22S. A straight line which passes through contact P, extends along tangential line T, and has a length of 50 μm such that contact P is defined as an intermediate point is drawn, and this straight line is defined as a long side 22L. Production of a small gap (hatched portion) g where no Al alloy wire 22 is present in surface-layer void measurement region 222 is permitted. A total cross-sectional area of voids present in surface-layer void measurement region 222 is not greater than 2 $\mu m^2$. With a small number of voids in the surface layer, cracking originating from a void in application of impact or repeated bending can readily be lessened. In addition, development of cracking from the surface layer to the inside can also be lessened and breakage originating from a void can be lessened. Therefore, Al alloy wire 22 in the embodiment is excellent in impact resistance and fatigue characteristics. When a total area of voids is large, large voids are present or a large number of small voids are present. Then, cracking originates from a void or cracking tends to develop. Consequently, impact resistance and fatigue characteristics become poor. As a total cross-sectional area of voids is smaller, there are a smaller number of voids. Breakage originating from a void is lessened and impact resistance and fatigue characteristics are excellent. Therefore, the total cross-sectional area is preferably not greater than 1.9 $\mu m^2$, further not greater than 1.8 $\mu m^2$, and not greater than 1.2 $\mu m^2$ and preferably closer to 0. A smaller number of voids tends to be present, for example, when a relatively low temperature of a melt is set in the casting process. In addition, as a cooling rate during casting, in particular, a cooling rate in a specific temperature region which will be described later, is increased, voids tend to be fewer and smaller.

Figure 4:
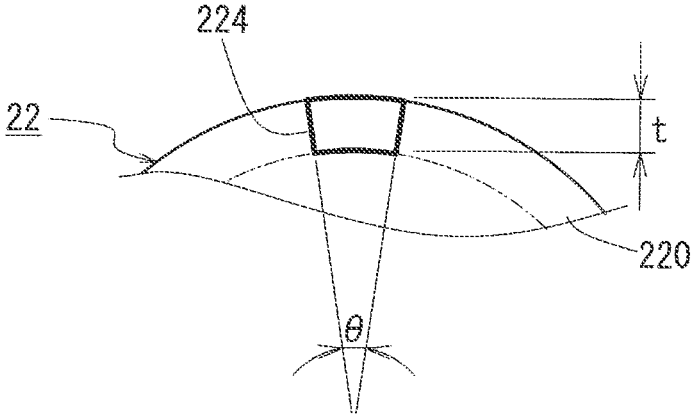
FIG. 4 is another illustrative view illustrating a method of measuring voids.

In an example where Al alloy wire 22 is a round wire or regarded substantially as a round wire, a void measurement region in the surface layer described above can be in a shape of a sector as shown in FIG. 4. FIG. 4 shows a void measurement region 224 with a bold line for facilitating understanding. As shown in FIG. 4, in the transverse section of Al alloy wire 22, surface-layer region 220 which extends by up to 30 μm in the direction of depth from the surface of the Al alloy wire, that is, an annular region having a thickness t of 30 μm, is taken. A region in a shape of a sector having an area of 1500 $\mu m^2$ (which is called void measurement region 224) is taken from surface-layer region 220. A central angle θ of the region in the shape of the sector having the area of 1500 $\mu m^2$ is found by using an area of annular surface-layer region 220 and the area 1500 $\mu m^2$ of void measurement region 224. Then, void measurement region 224 in the shape of the sector can be extracted from annular surface-layer region 220. With the total cross-sectional area of voids present in void measurement region 224 in the shape of the sector being not greater than 2 $\mu m^2$, Al alloy wire 22 can be excellent in impact resistance and fatigue characteristics for the reasons described above. When both of the rectangular surface-layer void measurement region and the void measurement region in the shape of the sector described above are taken and a total area of voids present in both of them is not greater than 2 $\mu m^2$, it is expected that reliability as a wire member excellent in impact resistance and fatigue characteristics is enhanced.

An Al alloy wire which includes a small number of voids also in the inside in addition to the surface layer represents one example of Al alloy wire 22 in the embodiment. Specifically, a rectangular region having a short side length of 30 μm and a long side length of 50 μm (which is called an inside void measurement region) is taken in the transverse section of Al alloy wire 22. The inside void measurement region is taken such that the center of this rectangle is superimposed on the center of Al alloy wire 22. In an example where Al alloy wire 22 is a shaped wire, the center of an inscribed circle is defined as the center of Al alloy wire 22 (to similarly be understood below). In at least one of the rectangular surface-layer void measurement region and the void measurement region in the shape of the sector described above, a ratio of a total cross-sectional area Sib of voids present in the inside void measurement region to a total cross-sectional area Sfb of voids present in the measurement region (Sib/Sfb) is not lower than 1.1 and not higher than 44. In a casting process, generally, solidification proceeds from a surface layer of a metal toward the inside thereof. Therefore, when gas in an atmosphere is dissolved in a melt, in the surface layer of a metal, gas is likely to escape to the outside of the metal, whereas in the inside of the metal, gas tends to remain as being confined. A wire member manufactured from such a cast material as a base material is considered to contain more voids in the inside than in the surface layer. When total cross-sectional area Sfb of voids in the surface layer is small as described above, a form low in ratio Sib/Sfb contains a smaller number of voids in the inside. Therefore, this form is likely to lessen occurrence of cracking or development of cracking in application of impact or repeated bending, achieves lessened breakage originating from a void, and is excellent in impact resistance and fatigue characteristics. As the ratio Sib/Sfb is lower, there are a smaller number of voids in the inside and impact resistance and fatigue characteristics are better. Therefore, the ratio Sib/Sfb is more preferably not higher than 40, further not higher than 30, not higher than 20, or not higher than 15. When the ratio Sib/Sfb is equal to or higher than 1.1, Al alloy wire 22 containing a small number of voids can be manufactured without excessively lowering a temperature of a melt, and such an Al alloy wire is considered as suitable for mass production. When the ratio Sib/Sfb is approximately from 1.3 to 6.0, it is considered that mass production is easily achieved.

Crystal Grain Size

An Al alloy wire in which an Al alloy has an average crystal grain size not greater than 50 μm represents one example of Al alloy wire 22 in the embodiment. Al alloy wire 22 having fine crystal structure is readily bent, excellent in pliability, and less likely to break in application of impact or repeated bending. This form of Al alloy wire 22 in the embodiment, with its small number of voids in the surface layer, is excellent in impact resistance and fatigue characteristics. The average crystal grain size is preferably not greater than 45 μm, further not greater than 40 μm, and not greater than 30 μm, because as the average crystal grain size is smaller, bending or the like is more readily performed and excellent impact resistance and fatigue characteristics are achieved. The crystal grain size tends to be fine, for example, when an element effective in making crystals finer among Ti, B, and element a is contained as described above, although depending on a composition or a manufacturing condition.

(Hydrogen Content)

An Al alloy wire which contains at most 8.0 ml/100 g of hydrogen represents one example of Al alloy wire 22 in the embodiment. Hydrogen may be one of factors for voids as described above. When a content of hydrogen with respect to a mass of 100 g of Al alloy wire 22 is not more than 8.0 ml, this Al alloy wire 22 contains a small number of voids and breakage originating from a void as described above can be lessened. As a content of hydrogen is lower, there may be a smaller number of voids. Therefore, the content is preferably not more than 7.8 ml/100 g, further not more than 7.6 ml/100 g, and not more than 7.0 ml/100 g and preferably closer to 0. Hydrogen in Al alloy wire 22 is considered to remain as dissolved hydrogen, through such a process that casting is performed in an atmosphere containing water vapor such as the air atmosphere and water vapor in the atmosphere is dissolved in a melt. Therefore, a content of hydrogen tends to be low, for example, by lessening solution of gas from the atmosphere by setting a relatively low temperature of a melt. The content of hydrogen tends to be lower when Cu is contained.

(Surface Oxide Film)

An Al alloy wire including a surface oxide film having a thickness not smaller than 1 nm and not greater than 120 nm represents one example of Al alloy wire 22 in the embodiment. When heat treatment such as aging treatment is performed, an oxide film can be present on a surface of Al alloy wire 22. When the surface oxide film has a small thickness not greater than 120 nm, an oxide interposed between a conductor 2 and a terminal portion 4 when terminal portion 4 (FIG. 2) is attached to an end portion of conductor 2 formed from Al alloy wire 22 can be less. As an amount of interposed oxide which is an electrically insulating material between conductor 2 and terminal portion 4 is small, increase in connection resistance between conductor 2 and terminal portion 4 can be lessened. When the surface oxide film is equal to or greater than 1 nm, corrosion resistance of Al alloy wire 22 can be enhanced. As the thickness of the surface oxide film is smaller in the range above, increase in connection resistance can be lessened, and as the thickness is greater, corrosion resistance can be enhanced. In consideration of suppression of increase in connection resistance and corrosion resistance, the surface oxide film can be not smaller than 2 nm and not greater than 115 nm, further not smaller than 5 nm and not greater than 110 nm, and further not greater than 100 nm. A thickness of the surface oxide film can be adjusted, for example, based on a condition for heat treatment. For example, when a concentration of oxygen in the atmosphere is high (for example, the air atmosphere), the surface oxide film tends to be large in thickness, and when a concentration of oxygen is low (for example, an inert gas atmosphere or a reducing gas atmosphere), the surface oxide film tends to be small in thickness.

(Characteristics)

Work Hardening Exponent

An Al alloy wire having a work hardening exponent not smaller than 0.05 represents one example of Al alloy wire 22 in the embodiment. When the Al alloy wire has a large work hardening exponent not smaller than 0.05, for example, Al alloy wire 22 is readily work-hardened in performing plastic working such as making a compressed strand wire obtained by compression forming a strand wire obtained by stranding together a plurality of Al alloy wires 22 or crimping terminal portion 4 to an end portion of conductor 2 made up of Al alloy wire 22 (which may be any of a solid wire, a strand wire, and a compressed strand wire). Even though a cross-sectional area is decreased by plastic working such as compression forming or crimping, strength can be enhanced by work hardening, and terminal portion 4 can firmly be fixed to conductor 2. Al alloy wire 22 thus large in work hardening exponent can make up conductor 2 excellent in fixability of terminal portion 4. As the work hardening exponent is larger, improvement in strength by work hardening can be expected. Therefore, the work hardening exponent is preferably not smaller than 0.08 and further not smaller than 0.1. The work hardening exponent tends to be large as breaking elongation is higher. Therefore, in order to increase the work hardening exponent, breaking elongation is enhanced, for example, by adjusting a type or a content of an additive element or a condition for heat treatment. Al alloy wire 22 having such a specific structure that a crystallized material (which will be described later) is fine and an average crystal grain size satisfies the specific range described above tends to satisfy the work hardening exponent not smaller than 0.05. Therefore, the work hardening exponent can be adjusted also by adjusting a type or a content of an additive element or a condition for heat treatment with the structure of the Al alloy being defined as an indicator.

Mechanical Characteristics and Electrical Characteristics

Al alloy wire 22 in the embodiment is high in tensile strength and 0.2% proof stress, excellent in strength, high in electrical conductivity, and also excellent in electrical conductive property by being composed of the specifically composed Al alloy described above and subjected representatively to heat treatment such as aging treatment. Depending on a composition or a manufacturing condition, breaking elongation can be high and toughness can also be excellent. Quantitatively, Al alloy wire 22 satisfies at least one selected from tensile strength not lower than 150 MPa, 0.2% proof stress not lower than 90 MPa, breaking elongation not lower than 5%, and electrical conductivity not lower than 40% IACS. Al alloy wire 22 which satisfies two items, in addition, three items, and in particular, all four items of the listed items is better in impact resistance and fatigue characteristics and also in electrical conductive property. Such Al alloy wire 22 can suitably be made use of for a conductor of an electrical wire.

When tensile strength is not lower than 150 MPa, strength is high and fatigue characteristics are excellent. When tensile strength is higher within the range, strength is higher, and tensile strength can be not lower than 160 MPa, further not lower than 180 MPa, and not lower than 200 MPa. When tensile strength is low, breaking elongation or electrical conductivity is readily enhanced.

When breaking elongation is not lower than 5%, flexibility and toughness are excellent and impact resistance is excellent. When breaking elongation is higher in the range above, flexibility and toughness are better and bending is more readily performed. Therefore, breaking elongation can be not lower than 6%, further not lower than 7%, and not lower than 10%.

Al alloy wire 22 is representatively made use of for conductor 2. When electrical conductivity is not lower than 40% IACS, the Al alloy wire is excellent in electrical conductive property and can suitably be used for a conductor of various electrical wires. The electrical conductivity is more preferably not lower than 45% IACS, further not lower than 48% IACS, and not lower than 50% IACS.

Al alloy wire 22 is preferably also high in 0.2% proof stress. When tensile strength is equal, as 0.2% proof stress is higher, fixability to terminal portion 4 tends to be better. When 0.2% proof stress is not lower than 90 MPa, fixability to the terminal portion is better in particular in attachment of the terminal portion by crimping. 0.2% proof stress can be not lower than 95 MPa, further not lower than 100 MPa, and not lower than 130 MPa.

When a ratio of 0.2% proof stress to tensile strength of Al alloy wire 22 is not lower than 0.5, 0.2% proof stress is sufficiently high, strength is high, breakage is less likely, and fixability to terminal portion 4 is also excellent as described above. As the ratio is higher, strength is higher and fixability to terminal portion 4 is also better. Therefore, the ratio is preferably not lower than 0.55 and further not lower than 0.6.

Tensile strength, 0.2% proof stress, breaking elongation, and electrical conductivity can be modified, for example, by adjusting a type or a content of an additive element or a manufacturing condition (a condition for wire drawing and a condition for heat treatment). For example, when an amount of an additive element is large, tensile strength or 0.2% proof stress tends to be high, and when an amount of an additive element is small, electrical conductivity tends to be high.

(Shape)

A shape of the transverse section of Al alloy wire 22 in the embodiment can be selected as appropriate in accordance with an application. For example, a round wire of which shape of the transverse section is circular is given as an example (see FIG. 1). In addition, a quadrangular wire of which shape of the transverse section is in a shape of a quadrangle such as a rectangle is given as an example. When Al alloy wire 22 makes up an elemental wire of a compressed strand wire described above, it is representatively shaped like a collapsed circle. When Al alloy wire 22 is a quadrangular wire, a rectangular region is readily used as a measurement region in evaluation of voids described above, and when Al alloy wire 22 is a round wire or the like, any of a rectangular region and a region in a shape of a sector may be used. A shape of a wire drawing die or a shape of a compression forming die is desirably selected such that the transverse section of Al alloy wire 22 is in a desired shape.

(Size)

A size of Al alloy wire 22 in the embodiment (an area of the transverse section or a diameter in an example of a round wire) can be selected as appropriate in accordance with an application. For example, when the Al alloy wire is used for a conductor of an electrical wire equipped in various wire harnesses such as a wire harness for cars, Al alloy wire 22 has a diameter not smaller than 0.2 mm and not greater than 1.5 mm. For example, when the Al alloy wire is used for a conductor of an electrical wire which constructs a wiring structure of a building, Al alloy wire 22 has a diameter not smaller than 0.1 mm and not greater than 3.6 mm. Since Al alloy wire 22 is a wire member high in strength, it is expected to suitably be used also for an application where a diameter is smaller, for example, not smaller than 0.1 mm and not greater than 1.0 mm.

[Al Alloy Strand Wire]

Al alloy wire 22 in the embodiment can be used for an elemental wire of a strand wire as shown in FIG. 1. Al alloy strand wire 20 in the embodiment is obtained by stranding together a plurality of Al alloy wires 22. Since Al alloy strand wire 20 is made up by stranding together a plurality of elemental wires (Al alloy wires 22) smaller in cross-sectional area than a solid Al alloy wire identical in conductor cross-sectional area, it is excellent in flexibility and readily bent. By stranding together, even though Al alloy wire 22 as each elemental wire is thin, the strand wire as a whole is excellent in strength. Al alloy strand wire 20 in the embodiment is made up of Al alloy wires 22 as elemental wires each having a specific structure containing a small number of voids. Therefore, even though impact or repeated bending is applied to Al alloy strand wire 20, Al alloy wire 22 as each elemental wire is less likely to break and the Al alloy strand wire is excellent in impact resistance and fatigue characteristics. When such items as the content of hydrogen and the crystal grain size described above of Al alloy wire 22 as each elemental wire satisfy the specific range described above, impact resistance and fatigue characteristics are further better.

The number of strands for Al alloy strand wire 20 can be selected as appropriate, and for example, it can be set to 7, 11, 16, 19, or 37. A strand pitch of Al alloy strand wire 20 can be selected as appropriate. When the strand pitch is at least ten times as large as a pitch diameter of Al alloy strand wire 20, the Al alloy strand wire is less likely to be unbound in attachment of terminal portion 4 to an end portion of conductor 2 made up of Al alloy strand wire 20 and workability in attachment of terminal portion 4 is excellent. When a strand pitch is at most forty times as large as a pitch diameter, the elemental wire is less likely to twist in bending, and hence breakage is less likely and fatigue characteristics are excellent. In consideration of prevention of being unbound and prevention of twisting, the strand pitch can be at least 15 times and at most 35 times and further at least 20 times and at most 30 times as large as a pitch diameter.

Al alloy strand wire 20 can be a compressed strand wire obtained by further performing compression forming. In this case, a diameter can be smaller than in an example of simple stranding together, or an outer shape can be in a desired shape (for example, a circular shape). When the work hardening exponent of Al alloy wire 22 as each elemental wire is large as described above, improvement in strength and hence improvement in impact resistance and fatigue characteristics can also be expected.

Specifications such as a composition and a structure, a thickness of a surface oxide film, a content of hydrogen, and mechanical characteristics and electrical characteristics of Al alloy wire 22 before stranding together are substantially maintained as specifications of each Al alloy wire 22 which makes up Al alloy strand wire 20. By performing heat treatment or the like after stranding together, a thickness of a surface oxide film or mechanical characteristics and electrical characteristics may be varied. A condition for stranding together is desirably adjusted such that specifications of Al alloy strand wire 20 are set to a desired value.

[Covered Electrical Wire]

Al alloy wire 22 in the embodiment or Al alloy strand wire 20 in the embodiment (which may be a compressed strand wire) can suitably be made use of for a conductor of an electrical wire. A bare conductor without an insulation cover can be made use of for any conductor of a covered electrical wire including an insulation cover. A covered electrical wire 1 in the embodiment includes conductor 2 and an insulation cover 3 which covers an outer circumference of conductor 2, and includes Al alloy wire 22 in the embodiment or Al alloy strand wire 20 in the embodiment as conductor 2. Since covered electrical wire 1 includes conductor 2 made up of Al alloy wire 22 or Al alloy strand wire 20 excellent in impact resistance and fatigue characteristics, it is excellent in impact resistance and fatigue characteristics. An insulating material which makes up insulation cover 3 can be selected as appropriate. Examples of the insulating material include polyvinyl chloride (PVC), a non-halogen resin, and a material excellent in flame resistance, and a known material can be made use of. A thickness of insulation cover 3 can be selected as appropriate so long as prescribed dielectric strength is achieved.

[Terminal-Equipped Electrical Wire]

Figure 2:
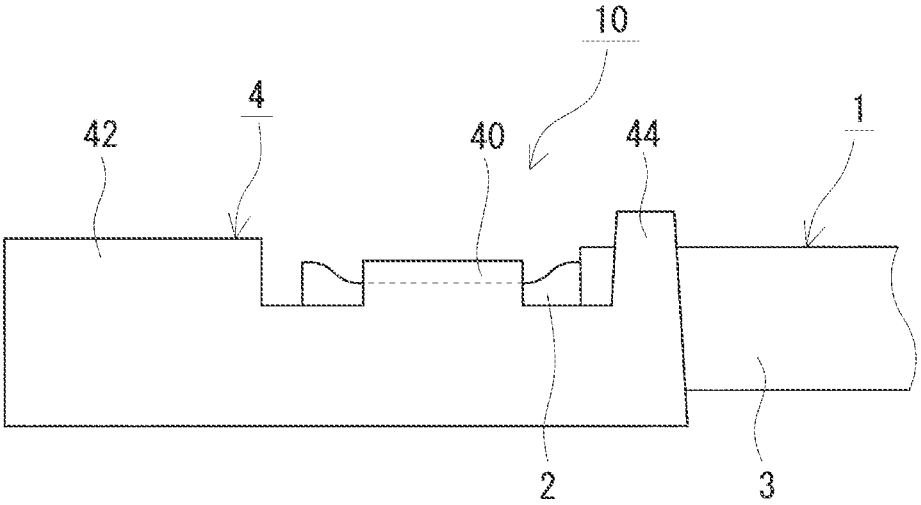
FIG. 2 is a schematic side view showing the vicinity of a terminal portion of a terminal-equipped electrical wire in the embodiment.

Covered electrical wire 1 in the embodiment can be made use of for electrical wires in various applications such as a wire harness provided on equipment such as cars and aircrafts, wires for various electrical appliances such as industrial robots, and wires in buildings. When the covered electrical wire is equipped in a wire harness or the like, terminal portion 4 is representatively attached to an end portion of covered electrical wire 1. A terminal-equipped electrical wire 10 in the embodiment includes covered electrical wire 1 in the embodiment and terminal portion 4 attached to an end portion of covered electrical wire 1 as shown in FIG. 2. Since terminal-equipped electrical wire 10 includes covered electrical wire 1 excellent in impact resistance and fatigue characteristics, it is excellent in impact resistance and fatigue characteristics. FIG. 2 shows a crimp terminal as terminal portion 4 which includes a female or male fitting portion 42 at one end, an insulation barrel portion 44 which holds insulation cover 3 at the other end, and a wire barrel portion 40 which holds conductor 2 in an intermediate portion. A melt type terminal portion for connection by melting of conductor 2 represents an example of other terminal portions 4.

A crimp terminal is electrically and mechanically connected to conductor 2 by removing insulation cover 3 at an end portion of covered electrical wire 1 to expose an end portion of conductor 2 and crimping the crimp terminal to the end portion. When Al alloy wire 22 or Al alloy strand wire 20 which makes up conductor 2 is high in work hardening exponent as described above, a portion of attachment of the crimp terminal in conductor 2 is excellent in strength owing to work hardening, although a cross-sectional area thereof is locally small. Therefore, for example, even when impact is applied at the time of connection between terminal portion 4 and a connection target in covered electrical wire 1 or repeated bending is further applied after connection, breakage of conductor 2 in the vicinity of terminal portion 4 can be lessened and terminal-equipped electrical wire 10 is excellent in impact resistance and fatigue characteristics.

When a surface oxide film is made smaller in thickness as described above in Al alloy wire 22 or Al alloy strand wire 20 which makes up conductor 2, an electrically insulating material (an oxide which forms a surface oxide film) interposed between conductor 2 and terminal portion 4 can be reduced and a connection resistance between conductor 2 and terminal portion 4 can be lowered. Therefore, terminal-equipped electrical wire 10 is excellent in impact resistance and fatigue characteristics and in addition also low in connection resistance.

As shown in FIG. 2, examples of terminal-equipped electrical wire 10 include a form of attachment of a single terminal portion 4 for each covered electrical wire 1 and a form including a single terminal portion (not shown) for a plurality of covered electrical wires 1. By binding a plurality of covered electrical wires 1 with a binder, terminal-equipped electrical wire 10 is readily handled.

[Method of Manufacturing Al Alloy Wire and Method of Manufacturing Al Alloy Strand Wire]

(Overview)

Al alloy wire 22 in the embodiment can representatively be manufactured by performing heat treatment (including aging treatment) at appropriate timing in addition to basic steps of casting, intermediate working such as (hot) rolling and extrusion, and wire drawing. Known conditions can be referred to as conditions in the basic steps and aging treatment. Al alloy strand wire 20 in the embodiment can be manufactured by stranding together a plurality of Al alloy wires 22. Known conditions can be referred to as conditions for stranding together.

(Casting Step)

In particular, Al alloy wire 22 in the embodiment containing a small number of voids in the surface layer is readily manufactured, for example, by setting a relatively low temperature of a melt in a casting process. Solution of gas in an atmosphere into the melt can be lessened and a cast material can be manufactured with the melt containing less dissolved gas. Hydrogen represents an example of the dissolved gas as described above, and hydrogen is considered to have resulted from decomposition of water vapor in the atmosphere or to have been contained in the atmosphere. By adopting a cast material less in dissolved gas such as dissolved hydrogen as a base material, a state that an Al alloy contains a small number of voids originating from dissolved gas is readily maintained in casting or steps thereafter in spite of plastic working such as rolling or wire drawing or heat treatment such as aging treatment. Consequently, voids present in the surface layer or the inside of Al alloy wire 22 which has a final diameter can satisfy the specific range described above. Furthermore, Al alloy wire 22 low in content of hydrogen as described above can be manufactured. Positions of voids confined in the Al alloy may be varied or a size of voids may be made smaller to some extent by performing steps after the casting process such as stripping or working accompanying plastic deformation (rolling, extrusion, and wire drawing). It is considered, however, that, if a total content of voids in the cast material is high, a total content of voids present in the surface layer or the inside and a content of hydrogen tend to be high (substantially maintained) in the Al alloy wire having a final diameter in spite of position change or variation in size. Therefore, in order to sufficiently decrease voids contained in the cast material itself, it is proposed to set a low temperature of the melt.

An example of a specific temperature of a melt is not lower than a liquidus temperature of the Al alloy and lower than 750° C. As the temperature of the melt is lower, dissolved gas can be reduced and voids in the cast material can be reduced. Therefore, the temperature of the melt is preferably not higher than 748° C. and further not higher than 745° C. When a temperature of the melt is high to some extent, a solid solution of an additive element is readily obtained. Therefore, a temperature of the melt can be not lower than 670° C. and further not lower than 675° C. By thus setting a low temperature of the melt, an amount of dissolved gas can be reduced even in casting in an atmosphere containing water vapor such as the air atmosphere, and hence a total content of voids originating from dissolved gas or a content of hydrogen can be reduced.

In addition to lowering in temperature of a melt, a rate of cooling in the casting process, in particular, a rate of cooling in a specific temperature region from a temperature of the melt to 650° C., is increased to some extent, so that increase in dissolved gas originating from the atmosphere is readily prevented. A liquidus region is mainly defined as the specific temperature region, because hydrogen is readily dissolved and dissolved gas is readily increased therein. With not too high a rate of cooling in the specific temperature region, it is considered that dissolved gas in the inside of a metal which is being solidified is readily emitted into an atmosphere which is the outside. In consideration of suppression of increase in dissolved gas, the cooling rate is preferably not lower than 1° C./second, further not lower than 2° C./second, and not lower than 4° C./second. In consideration of accelerated emission of dissolved gas from the inside of the metal, the cooling rate can be not higher than 30° C./second, in addition, lower than 25° C./second, not higher than 20° C./second, lower than 20° C./second, not higher than 15° C./second, and not higher than 10° C./second. Not too high a cooling rate is suitable also for mass production. Depending on a cooling rate, a supersaturated solid solution can be obtained. In this case, solution treatment does not have to be performed in a step after casting or it may be performed separately.

It has been found that, by setting a rate of cooling in a specific temperature region in the casting process to be high to some extent as described above, Al alloy wire 22 containing a fine crystallized material to some extent can be manufactured. As described above, a liquidus region is mainly defined as the specific temperature region and a crystallized material generated during solidification is readily made smaller by setting a high rate of cooling in the liquidus region. It is considered, however, that, when a temperature of the melt is lowered as described above and a cooling rate is too high, in particular, not lower than 25° C./second, generation of a crystallized material is less likely and an amount of solid solution of an additive element increases, which may cause lowering in electrical conductivity or difficulty in obtaining an effect of pinning of crystal grains by a crystallized material. In contrast, by setting a relatively low temperature of a melt and setting a rate of cooling in the temperature region to be high to some extent as described above, a large crystallized material is less likely to be included and a certain amount of crystallized material fine and relatively uniform in size tends to be contained. Finally, Al alloy wire 22 containing a small number of voids in the surface layer and containing a fine crystallized material to some extent can be manufactured. In consideration of making the crystallized material finer, the cooling rate is higher than 1° C./second and preferably equal to or higher than 2° C./second, although depending on a content of Mg and Si and an additive element such as element a.

From the foregoing, preferably, a temperature of a melt is not lower than 670° C. and lower than 750° C. and a rate of cooling from the temperature of the melt to 650° C. is lower than 20° C./second.

Furthermore, by setting a relatively high cooling rate in the casting process within the range described above, such effects as readily obtaining a cast material having fine crystal structure, obtaining a solid solution of an additive element readily to some extent, and readily making dendrite arm spacing (DAS) smaller (for example, 50 μm or smaller or further 40 μm or smaller) can also be expected.

Any of continuous casting and a metal mold casting (billet casting) can be used for casting. Continuous casting allows continuous manufacturing of a long cast material, and in addition, facilitated increase in cooling rate. Such effects as reduction in voids as described above, suppression of a large crystallized material, reduction in size of crystal grains or DAS, preparation of a solid solution of an additive element, and formation of a supersaturated solid solution depending on a rate of cooling can be expected.

(Step Up to Wire Drawing)

An intermediate work material obtained by subjecting a cast material representatively to plastic working (intermediate working) such as (hot) rolling or extrusion can be subjected to wire drawing. A continuous cast and rolled material (representing one example of an intermediate work material) can also be subjected to wire drawing by performing hot rolling in succession to continuous casting. Stripping or heat treatment can be performed before and/or after plastic working. By performing stripping, a surface layer where voids or a surface flaw may be present can be removed. Examples of heat treatment include heat treatment aiming at homogenization or solution of an Al alloy. Examples of conditions for homogenization include setting an atmosphere to the air atmosphere or a reducing atmosphere, setting a heating temperature approximately not lower than 450° C. and not higher than 600° C. (preferably not lower than 500° C.) and a retention time not shorter than 1 hour and not longer than 10 hours (preferably not shorter than 3 hours), and gradual cooling in which a cooling rate is not higher than 1° C./minute. By performing homogenization treatment under the conditions above onto the intermediate work material before wire drawing, Al alloy wire 22 high in breaking elongation and excellent in toughness is readily manufactured, and by employing the continuous cast and rolled material for the intermediate work material, Al alloy wire 22 better in toughness is readily manufactured. Conditions which will be described later can be made use of as conditions for solution treatment.

(Wire Drawing Step)

A wire-drawn member is formed by subjecting a base material (an intermediate work material) subjected to such plastic working as rolling described above to (cold) wire drawing until a prescribed final diameter is achieved. Wire drawing is performed representatively by using a wire drawing die. A degree of wire drawing is desirably selected as appropriate in accordance with a final diameter.

(Stranding Step)

In manufacturing Al alloy strand wire 20, a plurality of wire members (wire-drawn members or heat-treated members subjected to heat treatment after wire drawing) are prepared and these wire members are stranded together at a prescribed strand pitch (for example, 10 times to 40 times as large as a pitch diameter). When Al alloy strand wire 20 is made into a compressed strand wire, it is compression-formed into a prescribed shape after stranding together.

(Heat Treatment)

A wire-drawn member can be subjected to heat treatment at any timing, for example, while it is being drawn or after the wire drawing step. Examples of intermediate heat treatment performed during wire drawing include heat treatment aiming to remove strain introduced during wire drawing and to enhance workability. Examples of heat treatment after the wire drawing step include heat treatment aiming at solution treatment and heat treatment aiming at aging treatment. Heat treatment aiming at least at aging treatment is preferred. By performing aging treatment, a precipitated material containing an additive element such as Mg and Si and element α (for example, Zr) in an Al alloy depending on a composition can be dispersed in the Al alloy to thereby improve strength through age hardening and improve electrical conductivity owing to reduction in element in a solid solution state. Consequently, Al alloy wire 22 or Al alloy strand wire 20 high in strength and toughness and also excellent in impact resistance and fatigue characteristics can be manufactured. Examples of timing to perform heat treatment include at least one of during wire drawing, after wire drawing (before stranding), after stranding (before compression forming), and after compression forming. Heat treatment may be performed at a plurality of timings. When solution treatment is performed, solution treatment is performed before aging treatment (it does not have to be performed immediately before aging treatment). When intermediate heat treatment or solution treatment described above is performed during wire drawing or before stranding, workability can be enhanced to facilitate wire drawing or stranding. A condition for heat treatment is desirably adjusted such that characteristics after heat treatment satisfy a desired range. By performing heat treatment to satisfy, for example, breaking elongation not lower than 5%, Al alloy wire 22 of which work hardening exponent satisfies the specific range described above can also be manufactured.

Any of continuous treatment in which objects to be subjected to heat treatment are successively supplied to a heating vessel such as a pipe furnace or an electrical furnace for heating and batch treatment in which an object to be subjected to heat treatment is heated as being sealed in a heating vessel such as an atmospheric furnace can be made use of for heat treatment. In continuous treatment, for example, a temperature of a wire member is measured with a contactless thermometer and a control parameter is adjusted such that characteristics after heat treatment are within a prescribed range. Specific conditions for batch treatment include, for example, the following.

(Solution treatment) A heating temperature is approximately not lower than 450° C. and not higher than 620° C. (preferably not lower than 500° C. and not higher than 6000° C.), a retention time is not shorter than 0.005 second and not longer than 5 hours (preferably not shorter than 0.01 second and not longer than 3 hours), a cooling rate is not lower than 100° C./minute, and rapid cooling not lower than 200° C./minute is further performed.

(Intermediate heat treatment) A heating temperature is not lower than 250° C. and not higher than 550° C. and a duration of heating is not shorter than 0.01 second and not longer than 5 hours.

(Aging treatment) A heating temperature is not lower than 100° C. and not higher than 300° C. and further not lower than 140° C. and not higher than 250° C., and a retention time period is not shorter than 4 hours and not longer than 20 hours and further not longer than 16 hours.

Examples of the atmosphere during heat treatment include an atmosphere relatively high in content of oxygen such as the air atmosphere or a low-oxygen atmosphere lower in content of oxygen than the air atmosphere. With the air atmosphere being set, control of the atmosphere is not required, however, a surface oxide film large in thickness (for example, not smaller than 50 nm) tends to be formed. Therefore, when the air atmosphere is adopted, continuous treatment in which a retention time period is readily shortened is adopted so that Al alloy wire 22 including a surface oxide film having a thickness satisfying the specific range described above is readily manufactured. Examples of the low-oxygen atmosphere include a vacuum atmosphere (a pressure-reduced atmosphere), an inert gas atmosphere, and a reducing gas atmosphere. Examples of the inert gas include nitrogen and argon. Examples of the reducing gas include hydrogen gas, hydrogen-mixed gas containing hydrogen and inert gas, and a gas mixture of carbon monoxide and carbon dioxide. Though control of the atmosphere is required for the low-oxygen atmosphere, the surface oxide film is readily made smaller in thickness (for example, smaller than 50 nm). Therefore, when a low-oxygen atmosphere is adopted, batch treatment in which the atmosphere is readily controlled is adopted so that Al alloy wire 22 including a surface oxide film having a thickness satisfying the specific range described above or Al alloy wire 22 preferably smaller in thickness of the surface oxide film is readily manufactured.

As described above, by adjusting a composition of the Al alloy (preferably by adding both of Ti and B and an element effective in making crystals finer among elements α) and employing a continuous cast material or a continuous cast and rolled material as the base material, Al alloy wire 22 of which crystal grain size satisfies the range described above is readily manufactured. In particular, by setting a degree of wire drawing from a state of a base material or a continuous cast and rolled material obtained by subjecting the continuous cast material to plastic working such as rolling to a state of a wire-drawn member having a final diameter to 80% or higher and subjecting the wire-drawn member having the final diameter, a strand wire, or a compressed strand wire to heat treatment (in particular aging treatment) so as to achieve breaking elongation not lower than 5%, Al alloy wire 22 of which crystal grain size is not greater than 50 μm is further readily manufactured. In this case, heat treatment may be performed also during wire drawing. By controlling such crystal structure and controlling breaking elongation, Al alloy wire 22 having a work hardening exponent satisfying the specific range described above can also be manufactured.

(Other Steps)

In addition, examples of a method of adjusting a thickness of the surface oxide film include exposing a wire-drawn member having a final diameter to presence of hot water at a high temperature and a high pressure, applying water to the wire-drawn member having the final diameter, and providing a drying step after water cooling when water cooling is performed after heat treatment in continuous treatment in the air atmosphere. The surface oxide film tends to be greater in thickness by exposure to hot water or by application of water. By drying after water cooling, formation of a boehmite layer originating from water cooling is prevented and the surface oxide film tends to be smaller in thickness.

[Method of Manufacturing Covered Electrical Wire]

Covered electrical wire 1 in the embodiment can be manufactured by preparing Al alloy wire 22 or Al alloy strand wire 20 (which may be a compressed strand wire) in the embodiment which makes up conductor 2 and forming insulation cover 3 around the outer circumference of conductor 2 by extrusion or the like. Known conditions can be referred to as conditions for extrusion.

[Method of Manufacturing Terminal-Equipped Electrical Wire]

Terminal-equipped electrical wire 10 in the embodiment can be manufactured by removing insulation cover 3 at an end portion of covered electrical wire 1 to expose conductor 2 and attaching terminal portion 4 thereto.

Test Example 1

Al alloy wires were fabricated under various conditions and characteristics thereof were examined. Al alloy strand wires were made by using the Al alloy wires, and a covered electrical wire including the Al alloy strand wire as a conductor was further made. Characteristics of a terminal-equipped electrical wire obtained by attaching a crimp terminal to an end portion of the covered electrical wire were examined.

In this test, as shown in FIG. 5, steps shown in a manufacturing method A to a manufacturing method G were sequentially performed to make a wire rod (WR), and an aged member was finally manufactured. Specific steps are as below. In each manufacturing method, a step marked with a check mark was performed in a step shown in the first column in FIG. 5.

(Manufacturing Method A) WR→wire drawing→heat treatment (solution)→aging (Manufacturing Method B) WR→heat treatment (solution)→wire drawing→aging (Manufacturing Method C) WR→heat treatment (solution)→wire drawing→heat treatment (solution)→aging (Manufacturing Method D) WR→stripping wire drawing→intermediate heat treatment→wire drawing→heat treatment (solution)→aging (Manufacturing Method E) WR→heat treatment (solution)→stripping→wire drawing→intermediate heat treatment→wire drawing→heat treatment (solution)→aging (Manufacturing Method F) WR→wire drawing→aging (Manufacturing Method G) WR→heat treatment (solution, batch)→wire drawing→aging Samples Nos. 1 to 71, Nos. 101 to 106, and Nos. 111 to 115 are samples manufactured by manufacturing method C. Samples Nos. 72 to 77 are samples manufactured by manufacturing methods A, B, and D to G in this order. A specific manufacturing process in manufacturing method C will be described below. In each manufacturing method other than manufacturing method C, steps the same as in manufacturing method C are performed under similar conditions. Stripping in manufacturing methods D and E refers to removal of approximately 150 μm of a wire member from a surface thereof, and intermediate heat treatment refers to a continuous treatment by high-frequency induction heating (a temperature of a wire member being set to approximately 300° C.). Solution treatment in manufacturing method G refers to batch treatment under a condition of 540° C.×3 hours.

A melt of an Al alloy was prepared by preparing pure aluminum (at least 99.7 mass % of Al) as a base, melting pure aluminum, and introducing an additive element shown in Tables 1 to 4 into the obtained melt (molten aluminum) such that a content thereof was set to an amount shown in Tables 1 to 4 (mass %). A content of hydrogen was readily reduced or a foreign matter was readily reduced by performing treatment for removing hydrogen gas or treatment for removing a foreign matter onto the melt of the Al alloy of which component was modified.

A continuous cast and rolled material or a billet cast material was prepared by using the prepared melt of the Al alloy. The continuous cast and rolled material was made by continuously performing casting and hot rolling by using a belt-wheel type continuous casting roller and the prepared melt of the Al alloy, and a wire rod of ϕ 9.5 mm was obtained. The billet cast material was fabricated by pouring the melt of the Al alloy into a prescribed fixed mold and cooling the melt. After the billet cast material was subjected to homogenization treatment, it was subjected to hot rolling to thereby make a wire rod (a rolled member) of ϕ 9.5 mm. Tables 5 to 8 show a type of a casting method (the continuous cast and rolled material being denoted as "continuous" and the billet cast material being denoted as the "billet"), a temperature of the melt (° C.), and a cooling rate in the casting process (an average rate of cooling from the temperature of the melt to 650° C., ° C./second). The cooling rate was varied by adjusting a state of cooling by using a water cooling mechanism.

The wire rod was subjected to solution treatment (batch treatment) under a condition of 530° C.×5 hours and thereafter to cold wire drawing, to thereby make a wire-drawn member having a diameter of ϕ 0.3 mm, a wire-drawn member having a diameter of ϕ 0.25 mm, and a wire-drawn member having a diameter of ϕ 0.32 mm.

An aged member (the Al alloy wire) was made by subjecting the obtained wire-drawn member having a diameter of ϕ 0.3 mm to solution treatment and thereafter to aging treatment. Continuous treatment by high-frequency induction heating was adopted as solution treatment, in which a temperature of the wire member was measured with a contactless infrared thermometer and a condition of power feed was controlled such that the temperature of the wire member was not lower than 300° C. Batch treatment by using a box-shaped furnace was adopted as aging treatment, and it was performed at a temperature (° C.) for a time period (time period (H)) in an atmosphere shown in Tables 5 to 8. Sample No. 113 was subjected to boehmite treatment (100° C.×15 minutes) after aging treatment in the air atmosphere (marked with "*" in the field of Atmosphere in Table 8).

TABLE 1

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 1 | 0.03 | 0.04 | 0.8 | 0.15 | — | — | — | — | — | — | — | 0.15 | 0.22 | 0.01 | 0.002 |
| 2 | 0.03 | 0.02 | 1.5 | — | 0.2 | — | — | — | — | — | — | 0.2 | 0.25 | 0.01 | 0.002 |
| 3 | 0.2 | 0.06 | 3.3 | — | — | — | — | — | — | — | — | 0 | 0.26 | 0.01 | 0.002 |
| 4 | 0.2 | 0.1 | 2.0 | — | — | — | — | — | — | — | — | 0 | 0.3 | 0.02 | 0.004 |
| 5 | 0.2 | 0.25 | 0.8 | — | — | — | — | — | — | — | — | 0 | 0.45 | 0.01 | 0.002 |
| 6 | 0.35 | 0.1 | 3.5 | — | — | — | — | — | — | — | — | 0 | 0.45 | 0 | 0 |
| 7 | 0.5 | 0.15 | 3.3 | — | — | — | — | — | — | — | — | 0 | 0.65 | 0.01 | 0.002 |
| 8 | 0.5 | 0.2 | 2.5 | — | — | — | — | — | — | — | — | 0 | 0.7 | 0.02 | 0.004 |
| 9 | 0.55 | 0.32 | 1.7 | — | 0.1 | — | — | — | — | — | — | 0.1 | 0.97 | 0.02 | 0 |
| 10 | 0.5 | 0.5 | 1.0 | — | — | — | — | — | — | — | — | 0 | 1 | 0.01 | 0.002 |
| 11 | 0.6 | 0.22 | 2.7 | — | — | — | — | — | — | — | — | 0 | 0.82 | 0.02 | 0.004 |
| 12 | 0.6 | 0.5 | 1.2 | — | — | — | — | — | — | — | — | 0 | 1.1 | 0.01 | 0.002 |
| 13 | 1 | 0.4 | 2.5 | — | — | — | — | — | — | — | — | 0 | 1.4 | 0.01 | 0 |
| 14 | 1 | 1 | 1.0 | — | — | — | — | — | — | — | — | 0 | 2 | 0.01 | 0.002 |
| 15 | 1 | 1.2 | 0.8 | — | — | — | — | — | — | — | — | 0 | 2.2 | 0.02 | 0.004 |
| 16 | 1.5 | 0.5 | 3.0 | — | — | — | — | — | — | — | — | 0 | 2 | 0.02 | 0.004 |
| 17 | 1.5 | 1 | 1.5 | — | — | — | — | — | — | — | — | 0 | 2.5 | 0 | 0 |
| 18 | 1.5 | 2 | 0.8 | — | — | — | — | — | — | — | — | 0 | 3.5 | 0.008 | 0.002 |

TABLE 2

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 19 | 0.5 | 0.5 | 1.0 | 0.05 | — | — | — | — | — | — | — | 0.05 | 1.05 | 0.03 | 0.005 |
| 20 | 0.5 | 0.5 | 1.0 | 0.1 | — | — | — | — | — | — | — | 0.1 | 1.1 | 0.05 | 0.005 |
| 21 | 0.5 | 0.5 | 1.0 | 0.25 | — | — | — | — | — | — | — | 0.25 | 1.25 | 0.01 | 0.002 |
| 22 | 0.5 | 0.5 | 1.0 | — | 0.05 | — | — | — | — | — | — | 0.05 | 1.05 | 0.01 | 0.002 |
| 23 | 0.5 | 0.5 | 1.0 | — | 0.1 | — | — | — | — | — | — | 0.1 | 1.1 | 0.01 | 0 |
| 24 | 0.5 | 0.5 | 1.0 | — | 0.5 | — | — | — | — | — | — | 0.5 | 1.5 | 0.01 | 0 |
| 25 | 0.5 | 0.5 | 1.0 | — | — | 0.05 | — | — | — | — | — | 0.05 | 1.05 | 0.03 | 0.015 |
| 26 | 0.5 | 0.5 | 1.0 | — | — | 0.5 | — | — | — | — | — | 0.5 | 1.5 | 0.02 | 0.004 |
| 27 | 0.5 | 0.5 | 1.0 | — | — | — | 0.05 | — | — | — | — | 0.05 | 1.05 | 0.02 | 0.004 |
| 28 | 0.5 | 0.5 | 1.0 | — | — | — | 0.5 | — | — | — | — | 0.5 | 1.5 | 0.01 | 0.002 |
| 29 | 0.5 | 0.5 | 1.0 | — | — | — | — | 0.05 | — | — | — | 0.05 | 1.05 | 0.01 | 0.002 |
| 30 | 0.5 | 0.5 | 1.0 | — | — | — | — | 0.5 | — | — | — | 0.5 | 1.5 | 0.02 | 0.004 |
| 31 | 0.5 | 0.5 | 1.0 | — | — | — | — | — | 0.05 | — | — | 0.05 | 1.05 | 0.01 | 0.002 |
| 32 | 0.5 | 0.5 | 1.0 | — | — | — | — | — | 0.5 | — | — | 0.5 | 1.5 | 0.02 | 0.004 |
| 33 | 0.5 | 0.5 | 1.0 | — | — | — | — | — | — | 0.05 | — | 0.05 | 1.05 | 0.01 | 0.002 |
| 34 | 0.5 | 0.5 | 1.0 | — | — | — | — | — | — | 0.5 | — | 0.5 | 1.5 | 0.01 | 0.002 |
| 35 | 0.5 | 0.5 | 1.0 | — | — | — | — | — | — | — | 0.05 | 0.05 | 1.05 | 0.02 | 0.004 |
| 36 | 0.5 | 0.5 | 1.0 | — | — | — | — | — | — | — | 0.1 | 0.1 | 1.1 | 0.03 | 0.005 |
| 37 | 0.5 | 0.5 | 1.0 | 0.01 | — | — | — | — | — | — | — | 0.01 | 1.01 | 0.02 | 0.004 |
| 38 | 0.5 | 0.5 | 1.0 | 0.01 | 0.01 | 0.01 | 0.01 | 0.01 | 0.01 | 0.01 | 0.01 | 0.08 | 1.08 | 0.01 | 0.002 |
| 39 | 0.5 | 0.5 | 1.0 | 0.01 | — | 0.03 | — | — | — | — | 0.01 | 0.05 | 1.05 | 0.02 | 0.004 |
| 40 | 0.5 | 0.5 | 1.0 | 0.1 | 0.05 | — | — | — | — | — | — | 0.15 | 1.15 | 0 | 0 |
| 41 | 0.5 | 0.5 | 1.0 | 0.1 | — | 0.05 | — | — | — | — | — | 0.15 | 1.15 | 0.02 | 0.004 |
| 42 | 0.5 | 0.5 | 1.0 | 0.1 | — | — | 0.05 | — | — | — | — | 0.15 | 1.15 | 0.02 | 0.004 |
| 43 | 0.5 | 0.5 | 1.0 | 0.1 | — | — | — | 0.05 | — | — | — | 0.15 | 1.15 | 0.01 | 0.002 |
| 44 | 0.5 | 0.5 | 1.0 | 0.1 | — | — | — | — | 0.05 | — | — | 0.15 | 1.15 | 0.03 | 0.005 |
| 45 | 0.5 | 0.5 | 1.0 | 0.1 | — | — | — | — | — | 0.05 | — | 0.15 | 1.15 | 0.02 | 0.004 |
| 46 | 0.5 | 0.5 | 1.0 | 0.1 | — | — | — | — | — | — | 0.005 | 0.105 | 1.105 | 0.02 | 0.004 |
| 47 | 0.67 | 0.52 | 1.3 | 0.13 | — | — | — | 0.05 | — | — | — | 0.18 | 1.37 | 0.02 | 0.004 |

TABLE 3

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 48 | 0.5 | 0.5 | 1.0 | 0.1 | 0.05 | 0.05 | — | — | — | — | — | 0.2 | 1.2 | 0.01 | 0 |
| 49 | 0.5 | 0.5 | 1.0 | 0.1 | 0.05 | — | 0.05 | — | — | — | — | 0.2 | 1.2 | 0.02 | 0.004 |
| 50 | 0.5 | 0.5 | 1.0 | 0.1 | 0.05 | — | — | 0.05 | — | — | — | 0.2 | 1.2 | 0.02 | 0.004 |
| 51 | 0.5 | 0.5 | 1.0 | 0.1 | 0.05 | — | — | — | 0.05 | — | — | 0.2 | 1.2 | 0.02 | 0 |
| 52 | 0.5 | 0.5 | 1.0 | 0.1 | 0.05 | — | — | — | — | 0.05 | — | 0.2 | 1.2 | 0.01 | 0.002 |
| 53 | 0.5 | 0.5 | 1.0 | 0.1 | 0.05 | — | — | — | — | — | 0.01 | 0.16 | 1.16 | 0.02 | 0.004 |
| 54 | 0.5 | 0.5 | 1.0 | 0.1 | — | 0.05 | 0.05 | — | — | — | — | 0.2 | 1.2 | 0.02 | 0.004 |
| 55 | 0.5 | 0.5 | 1.0 | 0.1 | — | 0.05 | — | 0.05 | — | — | — | 0.2 | 1.2 | 0.01 | 0.002 |
| 56 | 0.5 | 0.5 | 1.0 | 0.1 | — | 0.05 | — | — | 0.05 | — | — | 0.2 | 1.2 | 0 | 0 |
| 57 | 0.5 | 0.5 | 1.0 | 0.1 | — | 0.05 | — | — | — | 0.05 | — | 0.2 | 1.2 | 0.02 | 0.004 |
| 58 | 0.5 | 0.5 | 1.0 | 0.1 | — | 0.05 | — | — | — | — | 0.01 | 0.16 | 1.16 | 0.02 | 0.004 |
| 59 | 0.5 | 0.5 | 1.0 | 0.1 | — | — | — | 0.05 | 0.05 | — | — | 0.2 | 1.2 | 0 | 0 |
| 60 | 0.5 | 0.5 | 1.0 | 0.1 | — | — | — | 0.05 | — | 0.05 | — | 0.2 | 1.2 | 0.02 | 0.004 |
| 61 | 0.5 | 0.5 | 1.0 | 0.1 | — | — | — | 0.05 | — | — | 0.01 | 0.16 | 1.16 | 0.02 | 0 |
| 62 | 0.5 | 0.5 | 1.0 | 0.1 | — | — | — | — | 0.05 | 0.05 | — | 0.2 | 1.2 | 0.01 | 0.002 |
| 63 | 0.5 | 0.5 | 1.0 | 0.1 | — | — | — | — | 0.05 | — | 0.01 | 0.16 | 1.16 | 0 | 0 |
| 64 | 0.5 | 0.5 | 1.0 | 0.1 | 0.05 | 0.05 | 0.05 | — | — | — | — | 0.25 | 1.25 | 0.02 | 0.004 |
| 65 | 0.5 | 0.5 | 1.0 | 0.1 | 0.05 | 0.05 | — | 0.05 | — | — | — | 0.25 | 1.25 | 0.02 | 0.004 |
| 66 | 0.5 | 0.5 | 1.0 | 0.1 | 0.05 | 0.05 | — | — | 0.05 | — | — | 0.25 | 1.25 | 0.01 | 0.002 |
| 67 | 0.5 | 0.5 | 1.0 | 0.1 | 0.05 | 0.05 | — | — | — | — | 0.02 | 0.22 | 1.22 | 0.02 | 0.005 |
| 68 | 0.5 | 0.5 | 1.0 | 0.25 | 0.01 | — | — | — | — | — | — | 0.26 | 1.26 | 0.02 | 0.005 |
| 69 | 1 | 1.3 | 0.8 | 0.1 | — | — | — | — | — | — | — | 0.1 | 2.4 | 0.03 | 0.015 |
| 70 | 1.5 | 0.5 | 3.0 | 0.1 | 0.05 | — | — | — | — | — | — | 0.15 | 2.15 | 0.03 | 0.015 |
| 71 | 0.4 | 0.7 | 0.6 | 0.1 | — | — | — | 0.005 | — | — | — | 0.105 | 1.205 | 0.01 | 0.005 |
| 72 | 0.5 | 0.5 | 1.0 | 0.1 | — | — | — | — | — | — | — | 0.1 | 1.1 | 0.05 | 0.005 |
| 73 | 0.5 | 0.5 | 1.0 | 0.1 | — | — | — | 0.05 | — | — | — | 0.15 | 1.15 | 0.01 | 0.002 |
| 74 | 0.5 | 0.5 | 1.0 | 0.1 | — | — | — | 0.05 | — | — | — | 0.15 | 1.15 | 0.01 | 0.002 |
| 75 | 0.5 | 0.5 | 1.0 | 0.1 | — | — | — | 0.05 | — | — | — | 0.15 | 1.15 | 0.01 | 0.002 |
| 76 | 0.5 | 0.5 | 1.0 | 0.1 | — | — | — | 0.05 | — | — | — | 0.15 | 1.15 | 0.01 | 0.002 |
| 77 | 0.5 | 0.5 | 1.0 | 0.1 | — | — | — | 0.05 | — | — | — | 0.15 | 1.15 | 0.01 | 0.002 |

TABLE 4

| Sample No. | Alloy Composition [Mass %] Mg | Si | Mg/Si | α Fe | Cu | Mn | Ni | Zr | Cr | Zn | Ga | Total | Total | Ti | B |
|---|---|---|---|---|---|---|---|---|---|---|---|---|---|---|---|
| 101 | 2 | 0.1 | 20.0 | — | — | — | — | — | — | — | — | 0 | 2.1 | 0.02 | 0.004 |
| 102 | 0.2 | 2 | 0.1 | — | — | — | — | — | — | — | — | 0 | 2.2 | 0.02 | 0.004 |
| 103 | 2.5 | 3 | 0.8 | — | — | — | — | — | — | — | — | 0 | 5.5 | 0.02 | 0.004 |
| 104 | 0.5 | 0.5 | 1.0 | 0.3 | — | 0.5 | — | 0.5 | — | — | — | 1.3 | 2.3 | 0.02 | 0.004 |
| 105 | 0.5 | 0.5 | 1.0 | — | — | — | — | — | 1 | — | — | 1 | 2 | 0.03 | 0.015 |
| 106 | 0.5 | 0.5 | 1.0 | 0.25 | 0.5 | — | — | — | 0.5 | — | — | 1.25 | 2.25 | 0.01 | 0.002 |
| 111 | 0.5 | 0.5 | 1.0 | 0.1 | — | — | — | — | — | — | — | 0.1 | 1.1 | 0.05 | 0.005 |
| 112 | 0.5 | 0.5 | 1.0 | 0.1 | — | — | — | — | — | — | — | 0.1 | 1.1 | 0.05 | 0.005 |
| 113 | 0.5 | 0.5 | 1.0 | 0.1 | — | — | — | — | — | — | — | 0.1 | 1.1 | 0.05 | 0.005 |
| 114 | 0.67 | 0.52 | 1.3 | 0.13 | — | — | — | 0.05 | — | — | — | 0.18 | 1.37 | 0.02 | 0.004 |
| 115 | 0.4 | 0.7 | 0.6 | 0.1 | — | — | — | 0.01 | — | — | — | 0.105 | 1.205 | 0.01 | 0.005 |

TABLE 5

| Sample No. | Manufacturing Condition: Casting | Casting Condition: Temperature of Melt [° C.] | Cooling Rate [° C./sec] | Aging Condition: Temperature [° C.] | Time Period [H] | Atmosphere |
|---|---|---|---|---|---|---|
| 1 | Continuous | 740 | 6 | 130 | 17 | Air Atmosphere |
| 2 | Billet | 690 | 2 | 120 | 18 | Air Atmosphere |
| 3 | Continuous | 700 | 3 | 160 | 10 | Nitrogen Gas |
| 4 | Continuous | 740 | 20 | 140 | 16 | Reducing Gas |
| 5 | Continuous | 700 | 6 | 130 | 17 | Air Atmosphere |
| 6 | Continuous | 700 | 2 | 180 | 8 | Air Atmosphere |
| 7 | Continuous | 730 | 2 | 210 | 8 | Air Atmosphere |
| 8 | Continuous | 745 | 4 | 160 | 12 | Reducing Gas |
| 9 | Continuous | 745 | 6 | 160 | 8 | Reducing Gas |
| 10 | Continuous | 730 | 1 | 220 | 6 | Air Atmosphere |
| 11 | Continuous | 730 | 2 | 140 | 16 | Reducing Gas |
| 12 | Continuous | 700 | 2 | 160 | 14 | Reducing Gas |
| 13 | Billet | 690 | 38 | 150 | 14 | Reducing Gas |
| 14 | Continuous | 670 | 2 | 160 | 15 | Air Atmosphere |
| 15 | Continuous | 745 | 22 | 180 | 20 | Reducing Gas |
| 16 | Continuous | 700 | 2 | 120 | 19 | Reducing Gas |
| 17 | Continuous | 710 | 7 | 220 | 7 | Air Atmosphere |
| 18 | Billet | 710 | 4 | 120 | 18 | Reducing Gas |

TABLE 6

| Sample No. | Manufacturing Condition: Casting | Casting Condition: Temperature of Melt [° C.] | Cooling Rate [° C./sec] | Aging Condition: Temperature [° C.] | Time Period [H] | Atmosphere |
|---|---|---|---|---|---|---|
| 19 | Billet | 670 | 9 | 120 | 19 | Air Atmosphere |
| 20 | Billet | 670 | 3 | 140 | 16 | Reducing Gas |
| 21 | Continuous | 740 | 6 | 220 | 5 | Air Atmosphere |
| 22 | Continuous | 710 | 2 | 160 | 10 | Reducing Gas |
| 23 | Continuous | 670 | 3 | 130 | 18 | Nitrogen Gas |
| 24 | Continuous | 670 | 2 | 180 | 11 | Reducing Gas |
| 25 | Continuous | 710 | 2 | 140 | 16 | Nitrogen Gas |
| 26 | Continuous | 690 | 2 | 160 | 14 | Reducing Gas |
| 27 | Continuous | 710 | 8 | 160 | 13 | Nitrogen Gas |
| 28 | Continuous | 720 | 24 | 120 | 18 | Reducing Gas |
| 29 | Continuous | 730 | 6 | 220 | 6 | Air Atmosphere |
| 30 | Continuous | 690 | 4 | 240 | 4 | Air Atmosphere |
| 31 | Billet | 700 | 1 | 140 | 16 | Nitrogen Gas |
| 32 | Continuous | 670 | 19 | 150 | 13 | Reducing Gas |
| 33 | Continuous | 740 | 2 | 140 | 16 | Reducing Gas |

TABLE 6-continued

| Sample No. | Manufacturing Condition | | | | | |
|---|---|---|---|---|---|---|
| | | Casting Condition | | Aging Condition | | |
| | Casting | Temperature of Melt [° C.] | Cooling Rate [° C./sec] | Temperature [° C.] | Time Period [H] | Atmosphere |
| 34 | Continuous | 680 | 2 | 200 | 5 | Reducing Gas |
| 35 | Continuous | 670 | 4 | 160 | 10 | Reducing Gas |
| 36 | Continuous | 700 | 3 | 220 | 8 | Air Atmosphere |
| 37 | Continuous | 680 | 4 | 140 | 16 | Reducing Gas |
| 38 | Continuous | 670 | 3 | 120 | 16 | Reducing Gas |
| 39 | Continuous | 710 | 2 | 200 | 9 | Reducing Gas |
| 40 | Continuous | 720 | 2 | 220 | 7 | Nitrogen Gas |
| 41 | Billet | 680 | 5 | 180 | 10 | Air Atmosphere |
| 42 | Continuous | 710 | 2 | 160 | 14 | Reducing Gas |
| 43 | Continuous | 680 | 10 | 160 | 10 | Reducing Gas |
| 44 | Continuous | 710 | 4 | 220 | 6 | Air Atmosphere |
| 45 | Continuous | 700 | 2 | 230 | 5 | Air Atmosphere |
| 46 | Continuous | 740 | 2 | 120 | 20 | Reducing Gas |
| 47 | Continuous | 680 | 10 | 160 | 8 | Reducing Gas |

TABLE 7

| Sample No. | Manufacturing Condition | | | | | |
|---|---|---|---|---|---|---|
| | | Casting Condition | | Aging Condition | | |
| | Casting | Temperature of Melt [° C.] | Cooling Rate [° C./sec] | Temperature [° C.] | Time Period [H] | Atmosphere |
| 48 | Billet | 700 | 2 | 160 | 12 | Reducing Gas |
| 49 | Continuous | 680 | 2 | 140 | 16 | Reducing Gas |
| 50 | Billet | 720 | 5 | 120 | 18 | Reducing Gas |
| 51 | Continuous | 690 | 2 | 200 | 10 | Air Atmosphere |
| 52 | Continuous | 740 | 2 | 160 | 14 | Reducing Gas |
| 53 | Continuous | 690 | 2 | 130 | 16 | Nitrogen Gas |
| 54 | Billet | 670 | 2 | 160 | 11 | Reducing Gas |
| 55 | Billet | 730 | 2 | 160 | 14 | Reducing Gas |
| 56 | Continuous | 680 | 4 | 120 | 18 | Air Atmosphere |
| 57 | Continuous | 680 | 4 | 180 | 13 | Reducing Gas |
| 58 | Continuous | 690 | 3 | 160 | 15 | Reducing Gas |
| 59 | Continuous | 745 | 10 | 150 | 15 | Nitrogen Gas |
| 60 | Continuous | 720 | 4 | 180 | 12 | Reducing Gas |
| 61 | Continuous | 700 | 4 | 140 | 16 | Nitrogen Gas |
| 62 | Continuous | 720 | 9 | 220 | 4 | Air Atmosphere |
| 63 | Continuous | 720 | 2 | 140 | 16 | Nitrogen Gas |
| 64 | Continuous | 720 | 2 | 180 | 11 | Nitrogen Gas |
| 65 | Continuous | 720 | 2 | 160 | 16 | Reducing Gas |
| 66 | Continuous | 710 | 3 | 180 | 10 | Reducing Gas |
| 67 | Continuous | 690 | 2 | 140 | 16 | Nitrogen Gas |
| 68 | Continuous | 680 | 4 | 180 | 9 | Reducing Gas |
| 69 | Continuous | 680 | 22 | 120 | 17 | Reducing Gas |
| 70 | Continuous | 720 | 10 | 150 | 14 | Nitrogen Gas |
| 71 | Continuous | 745 | 10 | 150 | 5 | Reducing Gas |
| 72 | Continuous | 680 | 10 | 160 | 10 | Reducing Gas |
| 73 | Continuous | 690 | 10 | 160 | 10 | Reducing Gas |
| 74 | Continuous | 680 | 15 | 160 | 10 | Reducing Gas |
| 75 | Continuous | 670 | 10 | 160 | 10 | Reducing Gas |
| 76 | Continuous | 680 | 10 | 160 | 10 | Reducing Gas |
| 77 | Continuous | 690 | 7 | 160 | 10 | Reducing Gas |

TABLE 8

| Sample No. | Manufacturing Condition | | | | | |
|---|---|---|---|---|---|---|
| | | Casting Condition | | Aging Condition | | |
| | Casting | Temperature of Melt [° C.] | Cooling Rate [° C./sec] | Temperature [° C.] | Time Period [H] | Atmosphere |
| 101 | Continuous | 700 | 2 | 140 | 16 | Nitrogen Gas |
| 102 | Continuous | 700 | 2 | 140 | 16 | Nitrogen Gas |
| 103 | Continuous | 740 | 2 | 140 | 16 | Nitrogen Gas |
| 104 | Continuous | 690 | 5 | 140 | 16 | Nitrogen Gas |
| 105 | Continuous | 720 | 2 | 140 | 16 | Nitrogen Gas |
| 106 | Continuous | 690 | 2 | 140 | 16 | Nitrogen Gas |
| 111 | Continuous | 820 | 2 | 140 | 16 | Reducing Gas |
| 112 | Continuous | 740 | 2 | 300 | 50 | Reducing Gas |
| 113 | Continuous | 690 | 2 | 140 | 16 | * |
| 114 | Continuous | 820 | 2 | 160 | 8 | Reducing Gas |
| 115 | Continuous | 750 | 25 | 150 | 5 | Reducing Gas |

(Mechanical Characteristics and Electrical Characteristics)

Tensile strength (MPa), 0.2% proof stress (MPa), breaking elongation (%), a work hardening exponent, and electrical conductivity (% IACS) of the obtained aged member having a diameter of ϕ 0.3 mm were measured. A ratio of 0.2% proof stress to tensile strength (proof stress/tension) was also calculated. Tables 9 to 12 show these results.

Tensile strength (MPa), 0.2% proof stress (MPa), and breaking elongation (%) were measured with the use of a general-purpose tensile tester in conformity with JIS Z 2241 (metallic materials-tensile testing-method of test at room temperature, 1998). The work hardening exponent is defined as an exponent n of true strain ε in an expression $\sigma=C\times\varepsilon^{n}$ where σ represents true stress and ε represents true strain in a plastic strain region when test force in the tensile test is applied in a uniaxial direction. In the expression, C represents a strength coefficient. Exponent n is calculated by drawing an S-S curve by conducting a tensile test by using the tensile tester (see also JIS G 2253, 2011). Electrical conductivity (% IACS) was measured by a bridge method.

(Fatigue Characteristics)

The obtained aged member having a diameter of ϕ 0.3 mm was subjected to a bending test and the number of times until breakage was counted. The bending test was conducted by using a commercially available cyclic bending tester. Repeated bending was performed by applying a load of 12.2 MPa by using a jig capable of applying 0.3% bending strain to a wire member as each sample. Each sample was subjected to the bending test three or more times, and Tables 9 to 12 show an average (count) thereof. It can be concluded that a large number of times until breakage indicates less likeliness of breakage by repeated bending and excellent fatigue characteristics.

TABLE 9

| Sample No. | ϕ 0.3 mm | | | | | | |
|---|---|---|---|---|---|---|---|
| | Proof Stress/Tension | Tensile Strength [MPa] | 0.2% Proof Stress [MPa] | Electrical Conductivity [% IACS] | Breaking Elongation [%] | Bending [Count] | Work Hardening Exponent |
| 1 | 0.59 | 152 | 90 | 60 | 30 | 17063 | 0.26 |
| 2 | 0.66 | 150 | 98 | 61 | 29 | 16542 | 0.19 |
| 3 | 0.71 | 189 | 134 | 54 | 24 | 22804 | 0.17 |
| 4 | 0.78 | 206 | 161 | 54 | 24 | 23616 | 0.17 |
| 5 | 0.68 | 212 | 144 | 53 | 24 | 23758 | 0.17 |
| 6 | 0.75 | 228 | 171 | 52 | 21 | 27860 | 0.15 |
| 7 | 0.68 | 251 | 171 | 51 | 17 | 30661 | 0.13 |
| 8 | 0.67 | 259 | 173 | 51 | 14 | 28803 | 0.12 |
| 9 | 0.67 | 294 | 197 | 54 | 9 | 32731 | 0.09 |
| 10 | 0.67 | 247 | 166 | 50 | 13 | 28607 | 0.11 |
| 11 | 0.70 | 263 | 185 | 51 | 11 | 30379 | 0.10 |
| 12 | 0.66 | 247 | 163 | 50 | 17 | 30159 | 0.13 |
| 13 | 0.70 | 291 | 203 | 49 | 10 | 34041 | 0.10 |
| 14 | 0.71 | 294 | 209 | 47 | 10 | 35684 | 0.10 |
| 15 | 0.71 | 315 | 224 | 48 | 13 | 35361 | 0.12 |
| 16 | 0.71 | 306 | 218 | 47 | 8 | 36595 | 0.09 |
| 17 | 0.70 | 348 | 243 | 43 | 6 | 40600 | 0.08 |
| 18 | 0.67 | 341 | 230 | 43 | 7 | 40256 | 0.08 |

TABLE 10

| | ϕ 0.3 mm | | | | | | |
|---|---|---|---|---|---|---|---|
| Sample No. | Proof Stress/Tension | Tensile Strength [MPa] | 0.2% Proof Stress [MPa] | Electrical Conductivity [% IACS] | Breaking Elongation [%] | Bending [Count] | Work Hardening Exponent |
| 19 | 0.70 | 235 | 164 | 52 | 21 | 26756 | 0.15 |
| 20 | 0.69 | 242 | 168 | 51 | 22 | 29421 | 0.16 |
| 21 | 0.67 | 246 | 164 | 49 | 19 | 28638 | 0.15 |
| 22 | 0.67 | 245 | 163 | 51 | 18 | 28025 | 0.14 |
| 23 | 0.67 | 240 | 162 | 51 | 17 | 27072 | 0.14 |
| 24 | 0.69 | 277 | 190 | 48 | 7 | 32533 | 0.09 |
| 25 | 0.73 | 240 | 176 | 52 | 20 | 29346 | 0.15 |
| 26 | 0.70 | 312 | 219 | 40 | 7 | 35966 | 0.08 |
| 27 | 0.69 | 242 | 168 | 51 | 23 | 28898 | 0.16 |
| 28 | 0.71 | 270 | 191 | 47 | 24 | 29844 | 0.17 |
| 29 | 0.71 | 240 | 170 | 51 | 19 | 27276 | 0.14 |
| 30 | 0.71 | 250 | 176 | 48 | 5 | 29672 | 0.07 |
| 31 | 0.67 | 242 | 163 | 52 | 20 | 28170 | 0.15 |
| 32 | 0.67 | 272 | 182 | 43 | 16 | 30109 | 0.13 |
| 33 | 0.67 | 235 | 157 | 52 | 21 | 27585 | 0.15 |
| 34 | 0.67 | 241 | 161 | 46 | 14 | 26831 | 0.12 |
| 35 | 0.70 | 250 | 175 | 50 | 19 | 29452 | 0.14 |
| 36 | 0.73 | 277 | 204 | 46 | 13 | 31435 | 0.11 |
| 37 | 0.68 | 235 | 159 | 52 | 21 | 25898 | 0.15 |
| 38 | 0.68 | 267 | 180 | 49 | 17 | 32427 | 0.13 |
| 39 | 0.74 | 248 | 185 | 50 | 18 | 28201 | 0.14 |
| 40 | 0.71 | 256 | 181 | 50 | 20 | 31000 | 0.15 |
| 41 | 0.73 | 308 | 225 | 44 | 18 | 33949 | 0.14 |
| 42 | 0.72 | 249 | 179 | 50 | 21 | 28235 | 0.15 |
| 43 | 0.72 | 253 | 182 | 50 | 16 | 29335 | 0.13 |
| 44 | 0.67 | 315 | 210 | 45 | 18 | 34729 | 0.14 |
| 45 | 0.69 | 248 | 170 | 49 | 19 | 29097 | 0.14 |
| 46 | 0.69 | 240 | 166 | 51 | 22 | 27787 | 0.16 |
| 47 | 0.72 | 253 | 182 | 52 | 16 | 29335 | 0.13 |

TABLE 11

| | ϕ 0.3 mm | | | | | | |
|---|---|---|---|---|---|---|---|
| Sample No. | Proof Stress/Tension | Tensile Strength [MPa] | 0.2% Proof Stress [MPa] | Electrical Conductivity [% IACS] | Breaking Elongation [%] | Bending [Count] | Work Hardening Exponent |
| 48 | 0.71 | 324 | 231 | 48 | 13 | 36102 | 0.11 |
| 49 | 0.67 | 253 | 169 | 51 | 20 | 27970 | 0.15 |
| 50 | 0.72 | 247 | 178 | 51 | 16 | 28369 | 0.13 |
| 51 | 0.71 | 249 | 176 | 51 | 21 | 27524 | 0.15 |
| 52 | 0.70 | 248 | 173 | 51 | 21 | 28955 | 0.15 |
| 53 | 0.69 | 248 | 171 | 51 | 22 | 28938 | 0.16 |
| 54 | 0.67 | 317 | 211 | 43 | 17 | 35884 | 0.13 |
| 55 | 0.76 | 301 | 229 | 45 | 8 | 33716 | 0.09 |
| 56 | 0.71 | 351 | 251 | 43 | 10 | 39315 | 0.10 |
| 57 | 0.72 | 300 | 216 | 45 | 18 | 33562 | 0.14 |
| 58 | 0.73 | 297 | 218 | 46 | 20 | 36172 | 0.15 |
| 59 | 0.71 | 281 | 199 | 50 | 15 | 33010 | 0.12 |
| 60 | 0.73 | 246 | 180 | 50 | 18 | 27698 | 0.14 |
| 61 | 0.70 | 244 | 172 | 51 | 18 | 29624 | 0.14 |
| 62 | 0.71 | 306 | 217 | 44 | 18 | 35731 | 0.14 |
| 63 | 0.72 | 308 | 223 | 46 | 21 | 36990 | 0.15 |
| 64 | 0.70 | 328 | 228 | 49 | 14 | 38527 | 0.12 |
| 65 | 0.72 | 316 | 227 | 49 | 12 | 34800 | 0.11 |
| 66 | 0.68 | 376 | 256 | 47 | 5 | 44420 | 0.05 |
| 67 | 0.73 | 321 | 235 | 49 | 14 | 39167 | 0.12 |
| 68 | 0.69 | 258 | 177 | 50 | 16 | 28786 | 0.13 |
| 69 | 0.71 | 360 | 256 | 45 | 9 | 40393 | 0.10 |
| 70 | 0.71 | 357 | 252 | 46 | 8 | 41929 | 0.09 |
| 71 | 0.71 | 265 | 187 | 50 | 18 | 31356 | 0.10 |
| 72 | 0.73 | 249 | 181 | 51 | 14 | 26923 | 0.12 |
| 73 | 0.73 | 250 | 182 | 50 | 15 | 28987 | 0.12 |
| 74 | 0.72 | 241 | 174 | 51 | 12 | 27943 | 0.11 |
| 75 | 0.72 | 257 | 185 | 50 | 16 | 29798 | 0.13 |

TABLE 11-continued

| Sample No. | Proof Stress/Tension | Tensile Strength [MPa] | 0.2% Proof Stress [MPa] | Electrical Conductivity [% IACS] | Breaking Elongation [%] | Bending [Count] | Work Hardening Exponent |
|---|---|---|---|---|---|---|---|
| | ϕ 0.3 mm | | | | | | |
| 76 | 0.72 | 245 | 177 | 51 | 13 | 28407 | 0.11 |
| 77 | 0.72 | 224 | 162 | 49 | 18 | 30381 | 0.14 |

TABLE 12

| Sample No. | Proof Stress/Tension | Tensile Strength [MPa] | 0.2% Proof Stress [MPa] | Electrical Conductivity [% IACS] | Breaking Elongation [%] | Bending [Count] | Work Hardening Exponent |
|---|---|---|---|---|---|---|---|
| | ϕ 0.3 mm | | | | | | |
| 101 | 0.87 | 264 | 231 | 40 | 4 | 30567 | 0.04 |
| 102 | 0.71 | 229 | 162 | 39 | 4 | 25467 | 0.04 |
| 103 | 0.67 | 383 | 256 | 37 | 3 | 42276 | 0.03 |
| 104 | 0.67 | 313 | 209 | 44 | 3 | 35937 | 0.03 |
| 105 | 0.68 | 320 | 219 | 46 | 4 | 35443 | 0.04 |
| 106 | 0.69 | 268 | 185 | 46 | 4 | 31291 | 0.04 |
| 111 | 0.70 | 237 | 166 | 51 | 17 | 19543 | 0.12 |
| 112 | 0.68 | 125 | 85 | 60 | 52 | 14758 | 0.28 |
| 113 | 0.70 | 242 | 170 | 51 | 21 | 27198 | 0.12 |
| 114 | 0.72 | 245 | 177 | 52 | 12 | 28407 | 0.11 |
| 115 | 0.71 | 256 | 182 | 50 | 16 | 29465 | 0.08 |

A strand wire was made by using the obtained wire-drawn member having a diameter of ϕ 0.25 mm or a diameter of ϕ 0.32 mm (the wire-drawn member not subjected to aging treatment described above and not subjected to solution treatment immediately before aging or the wire-drawn member not subjected to aging treatment in manufacturing methods B, F, and G). A strand wire including seven wire members each having a diameter of ϕ 0.25 mm was made. A compressed strand wire obtained by further compression-forming the strand wire including seven wire members each having a diameter of ϕ 0.32 mm was made. The strand wire and the compressed strand wire both had a cross-sectional area of 0.35 $mm^2$ (0.35 sq). A strand pitch was set to 20 mm (in an example of the wire-drawn member having a diameter of ϕ 0.25 mm, the strand pitch was approximately 40 times as large as the pitch diameter, and in an example of the wire-drawn member having a diameter of ϕ 0.32 mm, the strand pitch was approximately 32 times as large as the pitch diameter).

The obtained strand wire and compressed strand wire were sequentially subjected to solution treatment and aging treatment (only to aging treatment in manufacturing methods B, F, and G). Conditions for heat treatment were the same as the conditions for heat treatment applied to the wire-drawn member of 0.3 mm described above, continuous treatment by high-frequency induction heating was adopted as solution treatment, and batch treatment performed under conditions shown in Tables 5 to 8 (see above for * of sample No. 113) was adopted as aging treatment. A covered electrical wire was made by adopting the obtained aged strand wire as the conductor and forming an insulation cover (having a thickness of 0.2 mm) with an insulating material (a halogen-free insulating material) around the outer circumference of the conductor. In sample No. 112, a temperature for aging was set to 300° C. and a retention time period was set to 50 hours; aging was performed for a longer time period and at a higher temperature than those for other samples.

Items below of the obtained covered electrical wire as each sample or a terminal-equipped electrical wire obtained by attaching a crimp terminal to the covered electrical wire were examined. Items of both of an example including the strand wire as the conductor of the covered electrical wire and an example including the compressed strand wire as the conductor of the covered electrical wire were examined. Though Tables 13 to 16 show results in the example including the strand wire as the conductor, it was confirmed based on comparison with results in the example including the compressed strand wire as the conductor that there was no great difference therebetween.

(Observation of Structure)

Voids

A transverse section of the obtained covered electrical wire as each sample was taken and the conductor (the strand wire or the compressed strand wire formed from the Al alloy wire, to be understood similarly below) was observed with a scanning electron microscope (SEM) to examine voids in the surface layer and the inside as well as a crystal grain size. A rectangular surface-layer void measurement region having a short side of 30 μm long and a long side of 50 μm long was taken from a surface-layer region extending by up to 30 μm in a direction of depth from a surface of each Al alloy wire which made up the conductor. For one sample, one surface-layer void measurement region was taken from each of the seven Al alloy wires which formed the strand wire and thus seven surface-layer void measurement regions in total were taken. Then, a total cross-sectional area of voids present in each surface-layer void measurement region was found. A total cross-sectional area of voids in the seven surface-layer void measurement regions in total was examined for each sample. Tables 13 to 16 show a value obtained by averaging the total cross-sectional areas of voids in the seven measurement regions in total as a total area A ($\mu m^2$).

Instead of the rectangular surface-layer void measurement region described above, a void measurement region in a shape of a sector having an area of 1500 $\mu m^2$ was taken from an annular surface-layer region having a thickness of 30 μm, and a total area B ($\mu m^2$) of voids in the void measurement region in the shape of the sector was found as in the example of evaluation of the rectangular surface-layer void measurement region described above. Tables 13 to 16 show results.

A total cross-sectional area of voids is readily measured by subjecting an observed image to image processing such as binary processing to extract voids from the processed image.

In the transverse section, a rectangular inside void measurement region having a short side of 30 μm long and a long side of 50 μm long was taken in each Al alloy wire which made up the conductor. The inside void measurement region was taken such that the center of the rectangle was superimposed on the center of each Al alloy wire. Then, a ratio "inside/surface layer" of the total cross-sectional area of voids present in the inside void measurement region to the total cross-sectional area of voids present in the surface-layer void measurement region was calculated. Seven surface-layer void measurement regions in total and seven inside void measurement regions in total were taken for each sample, and a ratio "inside/surface layer" was calculated. Tables 13 to 16 show a value obtained by averaging the ratios "inside/surface layer" of the seven measurement regions in total as a ratio "inside/surface layer A". A ratio "inside/surface layer B" in the example of the void measurement region in the shape of the sector described above was calculated as in the example of evaluation of the rectangular surface-layer void measurement region described above, and Tables 13 to 16 show results.

Crystal Grain Size

In the transverse section, a test line was drawn on an image observed with the SEM in conformity with JIS G 0551 (steels-micrographic determination of the apparent grain size, 2013) and a length of interception of the test line in each crystal grain was defined as a crystal grain size (an intercept method). A length of the test line was set such that the test line intercepted ten or more crystal grains. Each crystal grain size was found by drawing three test lines in one transverse section, and Tables 13 to 16 show a value obtained by averaging these crystal grain sizes as an average crystal grain size (μm).

(Hydrogen Content)

The insulation cover was removed from the obtained covered electrical wire as each sample so as to leave only the conductor, and a content (ml/100 g) of hydrogen per 100 g of the conductor was measured. Tables 13 to 16 show results. The content of hydrogen was measured by an inert gas fusion method. Specifically, a sample was introduced into a graphite crucible while argon was flowing, to thereby melt the sample by heating, and hydrogen was extracted together with other gas. The content of hydrogen was found by passing the extracted gas through a separation column to separate hydrogen from other gas and conducting measurement with a thermal conductivity detector to quantify a concentration of hydrogen.

(Surface Oxide Film)

The insulation cover was removed from the obtained covered electrical wire as each sample so as to leave only the conductor, the strand wire or the compressed strand wire which formed the conductor was unbound, and the surface oxide film of each elemental wire was subjected to measurement as below. A thickness of the surface oxide film of each elemental wire (Al alloy wire) was examined. A thickness of the surface oxide film of each of the seven elemental wires in total was examined for each sample, and Tables 13 to 16 show a value obtained by averaging thicknesses of the surface oxide films of the seven elemental wires in total as a thickness (nm) of the surface oxide film. A cross-section of each elemental wire was taken by performing cross-section polisher (CP) treatment, and the cross-section was observed with the SEM. A thickness of the oxide film having a relatively large thickness exceeding approximately 50 nm was measured by using this image observed with the SEM. For an oxide film having a relatively small thickness not greater than approximately 50 nm as observed with the SEM, measurement was conducted by separately conducting analysis in the direction of the depth (repeated sputtering and analysis by energy dispersive X-ray analysis (EDX)) with the use of electron spectroscopy for chemical analysis (ESCA).

(Impact Resistance)

Impact resistance (J/m) of the obtained covered electrical wire as each sample was evaluated with reference to PTL 1. Generally, a weight was attached to a tip end of a sample in which a distance between evaluation points was set to 1 m, the weight was lifted upward by 1 m followed by freefall, and a maximum mass (kg) of the weight up to which the sample did not break was measured. A product of the mass of the weight and acceleration of gravity (9.8 $m/s^2$) and a drop of 1 m was calculated by multiplication, and a value calculated by dividing the product by the drop (1 m) was defined as an evaluation parameter (J/m or (N·m)/m) of impact resistance. Tables 13 to 16 show a value calculated by dividing the found evaluation parameter of impact resistance by the conductor cross-sectional area (0.35 $mm^2$) as an evaluation parameter ($J/m \cdot mm^2$) of impact resistance per unit area.

(Terminal Fixing Force)

Terminal fixing force (N) of the obtained terminal-equipped electrical wire as each sample was evaluated with reference to PTL 1. Generally, a terminal portion attached to one end of the terminal-equipped electrical wire was held by a terminal chuck, and a conductor portion resulting from removal of the insulation cover at the other end of the covered electrical wire was held by a conductor chuck. Maximum load (N) at the time of breakage of the terminal-equipped electrical wire as each sample having opposing ends held by these chucks was measured with a general-purpose tensile tester and this maximum load (N) was evaluated as terminal fixing force (N). Tables 13 to 16 show a value calculated by dividing the found maximum load by the conductor cross-sectional area (0.35 $mm^2$) as terminal fixing force ($N/mm^2$) per unit area.

TABLE 13

| Sample No. | 0.35 sq (ϕ 0.25 mm × 7-Strand Strand Wire or ϕ 0.32 mm × 7-Strand Compressed Strand Wire) | | | | | | | | | | |
|---|---|---|---|---|---|---|---|---|---|---|---|
| | Voids in Surface Layer Total Area A [μm$^2$] | Voids in Surface Layer Total Area B [μm$^2$] | Area Ratio of Voids Inside/ Surface Layer A | Area Ratio of Voids Inside/ Surface Layer B | Average Crystal Grain Size [μm] | Con-centration of Hydrogen [ml/100 g] | Thickness of Oxide Film [nm] | Impact Resistance [J/m] | Impact Resistance Unit Area [J/m · mm$^2$] | Terminal Fixing Force [N] | Terminal Fixing Force Unit Area [N/mm$^2$] |
| 1 | 1.6 | 1.7 | 2.0 | 2.1 | 19 | 8.0 | 57 | 8 | 23 | 40 | 114 |
| 2 | 0.5 | 0.5 | 5.2 | 5.1 | 13 | 2.8 | 15 | 8 | 22 | 43 | 124 |
| 3 | 0.6 | 0.6 | 3.3 | 3.4 | 25 | 3.0 | 34 | 8 | 23 | 56 | 161 |
| 4 | 1.5 | 1.6 | 1.3 | 1.3 | 7 | 7.7 | 12 | 9 | 25 | 64 | 184 |
| 5 | 0.7 | 0.7 | 2.0 | 2.1 | 19 | 3.7 | 55 | 9 | 26 | 62 | 178 |
| 6 | 1.0 | 1.0 | 5.0 | 5.2 | 48 | 3.1 | 10 | 8 | 24 | 70 | 199 |
| 7 | 1.3 | 1.3 | 6.9 | 6.7 | 36 | 5.9 | 28 | 8 | 22 | 74 | 211 |
| 8 | 2.0 | 2.0 | 2.8 | 2.8 | 46 | 7.9 | 45 | 6 | 18 | 76 | 216 |
| 9 | 1.9 | 1.9 | 1.8 | 1.8 | 31 | 7.9 | 45 | 5 | 13 | 86 | 245 |
| 10 | 1.7 | 1.7 | 7.9 | 7.8 | 2 | 6.4 | 40 | 6 | 16 | 72 | 206 |
| 11 | 1.7 | 1.7 | 5.8 | 5.6 | 33 | 6.0 | 6 | 5 | 15 | 78 | 224 |
| 12 | 0.7 | 0.8 | 4.8 | 4.7 | 44 | 3.2 | 2 | 7 | 21 | 72 | 205 |
| 13 | 0.4 | 0.5 | 1.1 | 1.1 | 24 | 2.6 | 48 | 5 | 14 | 86 | 247 |
| 14 | 0.1 | 0.1 | 4.6 | 4.6 | 8 | 0.7 | 18 | 5 | 14 | 88 | 251 |
| 15 | 1.7 | 1.6 | 1.2 | 1.2 | 25 | 7.2 | 6 | 7 | 21 | 94 | 270 |
| 16 | 0.9 | 0.9 | 5.5 | 5.6 | 17 | 3.3 | 8 | 4 | 12 | 92 | 262 |
| 17 | 1.0 | 0.9 | 1.6 | 1.7 | 48 | 4.4 | 118 | 4 | 10 | 103 | 296 |
| 18 | 1.3 | 1.4 | 3.0 | 3.0 | 45 | 4.4 | 48 | 4 | 12 | 100 | 286 |

TABLE 14

| Sample No. | 0.35 sq (ϕ 0.25 mm × 7-Strand Strand Wire or ϕ 0.32 mm × 7-Strand Compressed Strand Wire) | | | | | | | | | | |
|---|---|---|---|---|---|---|---|---|---|---|---|
| | Voids in Surface Layer Total Area A [μm$^2$] | Voids in Surface Layer Total Area B [μm$^2$] | Area Ratio of Voids Inside/ Surface Layer A | Area Ratio of Voids Inside/ Surface Layer B | Average Crystal Grain Size [μm] | Con-centration of Hydrogen [ml/100 g] | Thickness of Oxide Film [nm] | Impact Resistance [J/m] | Impact Resistance Unit Area [J/m · mm$^2$] | Terminal Fixing Force [N] | Terminal Fixing Force Unit Area [N/mm$^2$] |
| 19 | 0.2 | 0.2 | 1.3 | 1.2 | 32 | 0.7 | 34 | 9 | 25 | 70 | 199 |
| 20 | 0.2 | 0.2 | 4.1 | 4.0 | 41 | 1.0 | 2 | 9 | 27 | 72 | 205 |
| 21 | 1.5 | 1.6 | 2.0 | 2.1 | 26 | 7.6 | 23 | 9 | 24 | 72 | 205 |
| 22 | 1.2 | 1.2 | 6.1 | 5.9 | 27 | 4.5 | 20 | 8 | 22 | 71 | 204 |
| 23 | 0.1 | 0.1 | 3.4 | 3.3 | 4 | 0.4 | 46 | 7 | 21 | 70 | 201 |
| 24 | 0.2 | 0.3 | 4.6 | 4.8 | 21 | 1.2 | 18 | 4 | 10 | 82 | 233 |
| 25 | 0.9 | 0.9 | 5.2 | 5.2 | 12 | 4.0 | 27 | 9 | 25 | 73 | 208 |
| 26 | 0.8 | 0.8 | 6.9 | 6.7 | 32 | 2.5 | 45 | 4 | 11 | 93 | 266 |
| 27 | 1.1 | 1.2 | 1.4 | 1.3 | 6 | 4.8 | 31 | 10 | 28 | 72 | 205 |
| 28 | 1.0 | 0.9 | 1.3 | 1.3 | 5 | 5.0 | 27 | 11 | 33 | 81 | 230 |
| 29 | 1.6 | 1.7 | 1.9 | 1.9 | 9 | 6.2 | 61 | 8 | 23 | 72 | 205 |
| 30 | 0.6 | 0.6 | 2.5 | 2.6 | 20 | 2.3 | 1 | 4 | 11 | 75 | 213 |
| 31 | 0.7 | 0.6 | 31.0 | 31.1 | 10 | 3.6 | 13 | 9 | 25 | 71 | 202 |
| 32 | 0.2 | 0.3 | 1.5 | 1.5 | 41 | 0.4 | 48 | 8 | 22 | 79 | 227 |
| 33 | 1.7 | 1.7 | 4.6 | 4.5 | 44 | 7.1 | 14 | 9 | 25 | 69 | 196 |
| 34 | 0.5 | 0.4 | 6.5 | 6.5 | 25 | 1.7 | 4 | 6 | 17 | 70 | 201 |
| 35 | 0.3 | 0.2 | 2.5 | 2.4 | 13 | 0.5 | 27 | 8 | 24 | 74 | 213 |
| 36 | 0.9 | 0.9 | 3.5 | 3.4 | 26 | 3.3 | 7 | 6 | 18 | 84 | 240 |
| 37 | 0.4 | 0.4 | 2.6 | 2.6 | 35 | 1.9 | 38 | 9 | 25 | 69 | 197 |
| 38 | 0.3 | 0.2 | 4.1 | 3.9 | 2 | 0.6 | 22 | 8 | 23 | 78 | 223 |
| 39 | 1.1 | 1.1 | 4.6 | 4.5 | 32 | 4.7 | 4 | 8 | 23 | 76 | 216 |
| 40 | 0.9 | 0.9 | 5.5 | 5.3 | 33 | 4.9 | 41 | 9 | 26 | 76 | 219 |
| 41 | 0.3 | 0.4 | 2.2 | 2.2 | 21 | 1.1 | 37 | 10 | 28 | 93 | 267 |
| 42 | 0.9 | 0.8 | 4.8 | 4.8 | 5 | 4.1 | 26 | 9 | 26 | 75 | 214 |
| 43 | 0.6 | 0.6 | 1.1 | 1.1 | 11 | 1.8 | 1 | 6 | 17 | 76 | 218 |
| 44 | 0.9 | 1.0 | 3.1 | 3.0 | 31 | 3.7 | 68 | 10 | 29 | 92 | 262 |
| 45 | 1.0 | 1.1 | 6.9 | 7.1 | 7 | 3.9 | 49 | 8 | 24 | 73 | 209 |
| 46 | 1.3 | 1.4 | 6.1 | 6.2 | 43 | 7.0 | 9 | 9 | 26 | 71 | 203 |
| 47 | 0.6 | 0.6 | 1.1 | 1.1 | 9 | 1.8 | 1 | 7 | 21 | 76 | 218 |

TABLE 15

| Sample No. | 0.35 sq (ϕ 0.25 mm × 7-Strand Strand Wire or ϕ 0.32 mm × 7-Strand Compressed Strand Wire) | | | | | | | | | | |
|---|---|---|---|---|---|---|---|---|---|---|---|
| | Voids in Surface Layer Total Area A [μm$^2$] | Voids in Surface Layer Total Area B [μm$^2$] | Area Ratio of Voids Inside/ Surface Layer A | Area Ratio of Voids Inside/ Surface Layer B | Average Crystal Grain Size [μm] | Con-centration of Hydrogen [ml/100 g] | Thickness of Oxide Film [nm] | Impact Resistance [J/m] | Impact Resistance Unit Area [J/m · mm$^2$] | Terminal Fixing Force [N] | Terminal Fixing Force Unit Area [N/mm$^2$] |
| 48 | 1.1 | 1.0 | 5.5 | 5.5 | 32 | 3.6 | 4 | 8 | 21 | 97 | 278 |
| 49 | 0.4 | 0.4 | 4.6 | 4.5 | 5 | 2.1 | 41 | 9 | 26 | 74 | 211 |
| 50 | 1.4 | 1.4 | 2.2 | 2.3 | 41 | 5.2 | 32 | 7 | 20 | 74 | 213 |
| 51 | 0.4 | 0.4 | 4.8 | 4.9 | 22 | 2.4 | 62 | 9 | 27 | 74 | 212 |
| 52 | 1.2 | 1.2 | 5.5 | 5.6 | 6 | 6.9 | 6 | 9 | 26 | 74 | 211 |
| 53 | 0.7 | 0.6 | 4.8 | 4.8 | 44 | 2.8 | 5 | 9 | 27 | 73 | 210 |
| 54 | 0.1 | 0.1 | 4.6 | 4.5 | 27 | 0.5 | 44 | 9 | 27 | 92 | 264 |
| 55 | 1.1 | 1.1 | 5.0 | 4.9 | 46 | 6.4 | 43 | 4 | 12 | 93 | 265 |
| 56 | 0.3 | 0.4 | 2.7 | 2.7 | 27 | 1.3 | 8 | 6 | 18 | 105 | 301 |
| 57 | 0.6 | 0.6 | 3.1 | 3.1 | 21 | 1.7 | 8 | 10 | 28 | 90 | 258 |
| 58 | 0.9 | 0.8 | 3.8 | 3.8 | 2 | 3.0 | 43 | 10 | 29 | 90 | 257 |
| 59 | 1.4 | 1.4 | 1.1 | 1.1 | 46 | 7.5 | 28 | 8 | 21 | 84 | 240 |
| 60 | 1.2 | 1.2 | 2.6 | 2.6 | 15 | 5.3 | 44 | 8 | 22 | 75 | 213 |
| 61 | 0.8 | 0.8 | 2.5 | 2.5 | 13 | 3.6 | 13 | 8 | 22 | 73 | 208 |
| 62 | 0.8 | 0.9 | 1.3 | 1.3 | 5 | 4.7 | 26 | 10 | 28 | 91 | 261 |
| 63 | 1.2 | 1.2 | 5.8 | 5.6 | 39 | 4.7 | 18 | 12 | 33 | 93 | 266 |
| 64 | 1.4 | 1.4 | 6.9 | 7.0 | 20 | 5.1 | 19 | 8 | 24 | 97 | 278 |
| 65 | 1.0 | 1.0 | 5.8 | 6.1 | 5 | 5.2 | 35 | 7 | 19 | 95 | 271 |
| 66 | 0.8 | 0.9 | 4.1 | 4.1 | 6 | 4.3 | 25 | 4 | 11 | 111 | 316 |
| 67 | 0.5 | 0.5 | 5.2 | 5.3 | 12 | 2.0 | 27 | 8 | 23 | 97 | 278 |
| 68 | 0.6 | 0.6 | 3.1 | 2.9 | 14 | 1.8 | 1 | 7 | 21 | 76 | 217 |
| 69 | 0.4 | 0.5 | 1.2 | 1.2 | 32 | 1.5 | 10 | 6 | 17 | 108 | 308 |
| 70 | 0.9 | 0.9 | 1.1 | 1.2 | 44 | 4.8 | 25 | 5 | 14 | 107 | 305 |
| 71 | 1.9 | 1.9 | 5.2 | 5.4 | 7 | 7.9 | 25 | 10 | 29 | 75 | 214 |
| 72 | 0.7 | 0.7 | 1.1 | 1.1 | 10 | 1.7 | 2 | 6 | 18 | 75 | 215 |
| 73 | 0.6 | 0.5 | 1.1 | 1.2 | 12 | 2.0 | 1 | 7 | 19 | 76 | 216 |
| 74 | 0.6 | 0.5 | 1.1 | 1.1 | 11 | 1.8 | 3 | 5 | 15 | 73 | 207 |
| 75 | 0.3 | 0.2 | 1.1 | 1.1 | 12 | 0.7 | 1 | 7 | 21 | 77 | 221 |
| 76 | 0.5 | 0.5 | 1.1 | 1.1 | 11 | 1.4 | 5 | 6 | 16 | 74 | 211 |
| 77 | 0.6 | 0.5 | 1.5 | 1.5 | 10 | 1.9 | 7 | 7 | 20 | 67 | 193 |

TABLE 16

| Sample No. | 0.35 sq (ϕ 0.25 mm × 7-Strand Strand Wire or ϕ 0.32 mm × 7-Strand Compressed Strand Wire) | | | | | | | | | | |
|---|---|---|---|---|---|---|---|---|---|---|---|
| | Voids in Surface Layer Total Area A [μm$^2$] | Voids in Surface Layer Total Area B [μm$^2$] | Area Ratio of Voids Inside/ Surface Layer A | Area Ratio of Voids Inside/ Surface Layer B | Average Crystal Grain Size [μm] | Con-centration of Hydrogen [ml/100 g] | Thickness of Oxide Film [nm] | Impact Resistance [J/m] | Impact Resistance Unit Area [J/m · mm$^2$] | Terminal Fixing Force [N] | Terminal Fixing Force Unit Area [N/mm$^2$] |
| 101 | 0.6 | 0.6 | 6.1 | 6.0 | 46 | 3.3 | 39 | 2 | 5 | 87 | 248 |
| 102 | 1.0 | 1.1 | 5.5 | 5.5 | 36 | 3.4 | 16 | 2 | 5 | 68 | 196 |
| 103 | 1.3 | 1.3 | 4.6 | 4.4 | 5 | 7.0 | 8 | 2 | 6 | 112 | 319 |
| 104 | 0.8 | 0.8 | 2.2 | 2.3 | 42 | 2.7 | 17 | 2 | 5 | 91 | 261 |
| 105 | 0.9 | 0.9 | 4.8 | 4.7 | 24 | 5.0 | 38 | 2 | 7 | 94 | 270 |
| 106 | 0.5 | 0.5 | 5.5 | 5.6 | 6 | 2.7 | 25 | 2 | 5 | 79 | 227 |
| 111 | 2.7 | 2.6 | 5.5 | 5.3 | 42 | 9.4 | 22 | 7 | 20 | 70 | 201 |
| 112 | 1.4 | 1.5 | 6.5 | 6.3 | 55 | 7.1 | 37 | 12 | 33 | 35 | 100 |
| 113 | 0.7 | 0.7 | 5.2 | 5.1 | 35 | 2.6 | 315 | 9 | 26 | 72 | 206 |
| 114 | 2.9 | 2.9 | 5.5 | 5.7 | 9 | 10.4 | 1 | 5 | 15 | 69 | 197 |
| 115 | 2.1 | 2.1 | 1.7 | 1.7 | 8 | 8.1 | 35 | 8 | 23 | 73 | 209 |

The Al alloy wires as samples Nos. 1 to 77 (which may collectively be called an aged sample group below) composed of a specifically composed Al—Mg—Si based alloy containing Mg and Si within a specific range and containing as appropriate specific element a or the like within a specific range and subjected to aging treatment were higher in evaluation parameter values of impact resistance as shown in Tables 13 to 15 than the Al alloy wires as samples Nos. 101 to 106 outside the range of the specific composition (which may collectively be called a comparative sample group), and the evaluation parameter values thereof were not lower than 4 J/m. The Al alloy wire in the aged sample group was high in breaking elongation as shown in Tables 9 to 11 and also achieved the number of times of bending at a high level. It can thus be seen that the Al alloy wire in the aged sample group was excellent in impact resistance and fatigue characteristics in a more balanced manner than the Al alloy wire in the comparative sample group. The aged sample group was excellent in mechanical characteristics and electrical characteristics, that is, high in tensile strength, also high in electrical conductivity, also high in breaking elongation, and further also high in 0.2% proof stress here. Quantitatively, the Al alloy wire in the aged sample group satisfied tensile strength not lower than 150 MPa, 0.2% proof stress not lower than 90 MPa, breaking elongation not lower than 5%, and electrical conductivity not lower than 40% IACS. Furthermore, the Al alloy wire in the aged sample group was also high in ratio "proof stress/tension" between tensile strength and 0.2% proof stress and the ratio was not lower than 0.5. In addition, it can be seen that the Al alloy wire in the aged sample group was also excellent in fixability to the terminal portion as shown in Tables 13 to 15 (not lower than 40 N). One of the reasons may be because the Al alloy wire in the aged sample group was high in work hardening exponent which was not lower than 0.05 (Tables 9 to 11) and an effect of improvement in strength owing to work hardening in crimping a crimp terminal was satisfactorily obtained.

Results of evaluation by using rectangular measurement region A and results of evaluation by using measurement region B in the shape of the sector are referred to in connection with matters about voids below.

In particular, the Al alloy wire in the aged sample group as shown in Tables 13 to 15 had a total area of voids in the surface layer not greater than 2.0 $\mu m^2$ which was smaller than that of the Al alloy wires as samples Nos. 111, 114, and 115 shown in Table 16. With attention being paid to voids in the surface layer, comparison between samples Nos. 20 and 111 identical in composition, between samples Nos. 47 and 114 identical in composition, and between samples Nos. 71 and 115 identical in composition was made. It can be seen that samples Nos. 20, 47, and 71 smaller in number of in voids were better in impact resistance (Tables 14 and 15) and greater in number of times of bending and hence also excellent in fatigue characteristics (Tables 10 and 11). One of the reasons may be because the Al alloy wires as samples Nos. 111, 114, and 115 including many voids in the surface layer tend to break because of cracking originating from a void in application of impact or repeated bending. It can thus be concluded that impact resistance and fatigue characteristics can be improved by reducing voids in the surface layer of the Al alloy wire. The Al alloy wire in the aged sample group as shown in Tables 13 to 15 is lower in content of hydrogen than the Al alloy wires as samples Nos. 111, 114, and 115 shown in Table 16. It is thus considered that hydrogen is one of factors for voids. It is considered that a temperature of the melt is high in samples Nos. 111, 114, and 115 and much dissolved gas tends to be present in the melt, and considered that much hydrogen was derived from dissolved gas. It can thus be concluded that setting a relatively low temperature (lower than 750° C.) of the melt in the casting process is effective for reducing voids in the surface layer.

In addition, it can be seen that hydrogen is readily reduced by containing Cu, based on comparison between sample No. 10 (Table 13) and samples Nos. 22 to 24 (Table 14).

It can further be concluded from this test as follows.

(1) As shown in Tables 13 to 15, the Al alloy wire in the aged sample group is smaller in number of voids not only in the surface layer but also in the inside. Quantitatively, a ratio "inside/surface layer" of the total area of voids is not higher than 44, it is not higher than 35 here, and it is not higher than 20 and further not higher than 10 in many samples. Based on comparison between samples Nos. 20 and 111 identical in composition, sample No. 20 lower in ratio "inside/surface layer" was greater in number of times of bending (Tables 10 and 12) and also larger in parameter value of impact resistance (Tables 14 and 16). One of the reasons may be because, in the Al alloy wire as sample No. 111 including many voids in the inside, cracking developed from the surface layer to the inside through voids in application of repeated bending and breakage was likely. It can thus be concluded that impact resistance and fatigue characteristics can be improved by reducing voids in the surface layer and the inside of the Al alloy wire. It can be concluded from this test that, as a cooling rate is higher, the ratio "inside/surface layer" tends to be lowered. Therefore, it can be concluded that, in order to reduce voids in the inside, setting a relatively low temperature of the melt in the casting process and setting a cooling rate relatively high to some extent in a temperature region up to 650° C. (higher than 0.5° C./second and further not lower than 1° C./second and preferably lower than 25° C./second and further lower than 20° C./second) are effective.

(2) As shown in Tables 13 to 15, the Al alloy wire in the aged sample group was small in crystal grain size. Quantitatively, the average crystal grain size was not greater than 50 μm, and many samples had an average crystal grain size not greater than 35 μm and further not greater than 30 μm, and some samples also had an average crystal grain size not greater than 20 μm, which were smaller than that of sample No. 112 (Table 16). Based on comparison between sample No. 20 (Table 10) and sample No. 112 (Table 12) identical in composition, sample No. 20 was approximately two times larger in number of times of bending. Therefore, it is considered that a small crystal grain size contributes in particular to improvement in fatigue characteristics. In addition, it can be concluded from this test that a crystal grain size is readily made smaller, for example, by setting a relatively low temperature for aging or setting a relatively short retention time.

(3) As shown in Tables 13 to 15, the Al alloy wire in the aged sample group had a surface oxide film, however, a thickness thereof was as small as 120 nm or less (see comparison with sample No. 113 in Table 16). Therefore, it is considered that the Al alloy wire can achieve suppressed increase in resistance of connection to the terminal portion and can construct a low-resistance connection structure. The insulation cover was removed from the covered electrical wire in the aged sample group to leave only the conductor, and the strand wire or the compressed strand wire which formed the conductor was unbound to elemental wires. Any one elemental wire as a sample was subjected to a salt water spray test and corrosion was visually checked. Then, no corrosion was observed. Conditions for the salt water spray test include use of a NaCl aqueous solution at a concentration of 5 mass % and a test period of 96 hours. It can thus be considered that formation of a surface oxide film of an appropriate thickness (not smaller than 1 nm) contributes to improvement in corrosion resistance. In addition, it can be concluded from this test that the surface oxide film tends to be large in thickness when heat treatment such as aging treatment is performed in the air atmosphere or under a condition to allow formation of a boehmite layer and that the surface oxide film tends to be small in thickness in a low-oxygen atmosphere.

(4) As shown in Tables 11 and 15, even though change to manufacturing methods A, B, and D to G is made (samples Nos. 72 to 77), it can be concluded that an Al alloy wire small in number of voids in the surface layer and excellent in impact resistance and fatigue characteristics is obtained. In particular, by appropriately setting a temperature of a melt during casting, an Al alloy wire small in number of voids in the surface layer and excellent in impact resistance and fatigue characteristics in spite of various changes in subsequent steps can be manufactured, and a degree of freedom in manufacturing condition is high.

An Al alloy wire composed of a specifically composed Al—Mg—Si based alloy, subjected to aging treatment, and including a small number of voids in the surface layer achieved high strength, high toughness, and high electrical conductivity, also excellent strength of connection to the terminal portion, and also excellent impact resistance and fatigue characteristics. Such an Al alloy wire is expected to suitably be used for a conductor of a covered electrical wire, in particular, a conductor of a terminal-equipped electrical wire to which a terminal portion is attached.

The present invention is not limited to these exemplifications but is defined by the terms of the claims, and is intended to include any modifications within the scope and meaning equivalent to the terms of the claims.

For example, a composition of an alloy in Test Example 1, a cross-sectional area of a wire member, the number of strands in a strand wire, and a manufacturing condition (a temperature of a melt, a cooling rate in casting, timing of heat treatment, and a condition for heat treatment) can be modified as appropriate.

[Additional Aspect]

An aluminum alloy wire excellent in impact resistance and fatigue characteristics can be configured as below.

[Additional Aspect 1]

An aluminum alloy wire composed of an aluminum alloy, the aluminum alloy containing at least 0.03 mass % and at most 1.5 mass % of Mg, at least 0.02 mass % and at most 2.0 mass % of Si, and a remainder composed of Al and an inevitable impurity, a mass ratio Mg/Si being not lower than 0.5 and not higher than 3.5, in a transverse section of the aluminum alloy wire, a void measurement region in a shape of a sector having an area of 1500 $\mu m^2$ being taken from an annular surface-layer region extending by up to 30 μm in a direction of depth from a surface of the aluminum alloy wire, and a total cross-sectional area of voids present in the void measurement region in the shape of the sector being not greater than 2 $\mu m^2$.

The aluminum alloy wire described in [Additional Aspect 1] is better in impact resistance and fatigue characteristics when at least one of a mechanical characteristic such as tensile strength, 0.2% proof stress, and breaking elongation, a crystal grain size, a work hardening exponent, and a content of hydrogen satisfies the specific range described above. The aluminum alloy wire described in [Additional Aspect 1] is excellent in electrical conductive property when its electrical conductivity satisfies the specific range described above and excellent in corrosion resistance when a surface oxide film thereof satisfies the specific range described above. The aluminum alloy wire described in [Additional Aspect 1] can be used for the aluminum alloy strand wire, the covered electrical wire, or the terminal-equipped electrical wire described above.

REFERENCE SIGNS LIST

1 covered electrical wire
10 terminal-equipped electrical wire
2 conductor
20 aluminum alloy strand wire
22 aluminum alloy wire (elemental wire)
220 surface-layer region
222 surface-layer void measurement region
224 void measurement region
22S short side
22L long side
P contact
T tangential line
C straight line
g gap
3 insulation cover
4 terminal portion
40 wire barrel portion
42 fitting portion
44 insulation barrel portion

The invention claimed is:

1. An aluminum alloy wire composed of an aluminum alloy, the aluminum alloy containing at least 0.03 mass% and at most 1.5 mass % of Mg, at least 0.02 mass % and at most 2.0 mass % of Si, and a remainder composed of Al and an inevitable impurity, a mass ratio Mg/Si being not lower than 0.5 and not higher than 3.5, in a transverse section of the aluminum alloy wire, a rectangular surface-layer void measurement region having a short side of 30 μm long and a long side of 50 μm long being taken from a surface-layer region extending by up to 30 μm in a direction of depth from a surface of the aluminum alloy wire, a total cross-sectional area of voids present in the surface-layer void measurement region being not greater than 2 $\mu m^2$, the aluminum alloy wire having a diameter not smaller than 0.1 mm and not greater than 3.6 mm, and an impact resistance equal to or more than 4 J/m and equal to or less than 12 J/m.

2. The aluminum alloy wire according to claim 1, wherein in the transverse section of the aluminum alloy wire, a rectangular inside void measurement region having a short side of 30 μm long and a long side of 50 μm long is taken such that a center of this rectangle is superimposed on a center of the aluminum alloy wire, and a ratio of a total cross-sectional area of voids present in the inside void measurement region to the total cross-sectional area of the voids present in the surface-layer void measurement region is not lower than 1.1 and not higher than 44.

3. The aluminum alloy wire according to claim 1, wherein the aluminum alloy further contains at most 1.0 mass % in total of at least one element selected from among Fe, Cu, Mn, Ni, Zr, Cr, Zn, and Ga, Fe is contained within a range not lower than 0.01 mass % and not higher than 0.25 mass %, each of Cu, Mn, Ni, Zr, Cr, and Zn is contained within a range not lower than 0.01 mass % and not higher than 0.5 mass %, and Ga is contained within a range not lower than 0.005 mass % and not higher than 0.1 mass %.

4. The aluminum alloy wire according to claim 1, wherein the aluminum alloy further contains at least one of at least 0 mass % and at most 0.05 mass % of Ti and at least 0 mass % and at most 0.005 mass % of B.

5. The aluminum alloy wire according to claim 1, wherein the aluminum alloy has an average crystal grain size not greater than 50 μm.

6. The aluminum alloy wire according to claim 1, the aluminum alloy wire having a work hardening exponent not smaller than 0.05.

7. The aluminum alloy wire according to claim 1, the aluminum alloy wire comprising a surface oxide film having a thickness not smaller than 1 nm and not greater than 120 nm.

8. The aluminum alloy wire according to claim 1, the aluminum alloy wire containing at most 8.0 ml/100 g of hydrogen.

9. An aluminum alloy strand wire made by stranding together a plurality of the aluminum alloy wires according to claim 1.

10. The aluminum alloy strand wire according to claim 9, wherein a strand pitch is at least 10 times and at most 40 times as large as a pitch diameter of the aluminum alloy strand wire.

11. A covered electrical wire comprising:

a conductor; and an insulation cover which covers an outer circumference of the conductor, the conductor including the aluminum alloy strand wire according to claim 9.

12. A terminal-equipped electrical wire comprising:

the covered electrical wire according to claim 11; and a terminal portion attached to an end portion of the covered electrical wire.

* * * * *